US006522979B1

(12) United States Patent
Yavari et al.

(10) Patent No.: US 6,522,979 B1
(45) Date of Patent: Feb. 18, 2003

(54) FLUID CELL PROCESS MODELING

(75) Inventors: Parviz Yavari, Huntington Beach, CA (US); Tiencheng Wang, Rolling Hills E., CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 168 days.

(21) Appl. No.: 09/691,640

(22) Filed: Oct. 18, 2000

(51) Int. Cl.[7] ..... G01L 5/00; G01B 5/00
(52) U.S. Cl. ..... 702/42; 702/33; 702/35
(58) Field of Search ..... 702/33, 34, 35, 702/41, 42, 43, 44; 700/95, 96, 97; 72/56–57, 403, 707

(56) References Cited

U.S. PATENT DOCUMENTS 4,972,090 A * 11/1990 Eaton ..... 250/559.13
4,984,180 A * 1/1991 Wada et al. ..... 700/182
5,463,558 A 10/1995 Tang et al.
5,508,935 A 4/1996 Pourboghrat
5,552,995 A 9/1996 Sebastian
5,587,914 A 12/1996 Conradson et al.
5,822,207 A 10/1998 Hazama et al.
5,864,482 A 1/1999 Hazama et al.
5,935,475 A * 8/1999 Scoles et al. ..... 219/633

* cited by examiner

*Primary Examiner*—Bryan Bui
(74) *Attorney, Agent, or Firm*—Stetina Brunda Garred & Brucker

(57) ABSTRACT

A method for selecting a suitable workpiece having a material composition and a thickness for forming an article. The method calculates expected strain resulting from straight bends, stretch flanges, and shrink flanges utilizing customized strain correlations developed from strain test data of work piece samples. The calculated straight bend strain and stretch flange strain from multiple bends are then compared with the material yield strain to determine workpiece suitability. The shrink flange strain is compared with the material buckle stain to determine workpiece suitability. The method also calculates a spring back deformation for determining suitability of the workpiece and the press forming procedures.

63 Claims, 31 Drawing Sheets

FIG. 2B

FACTOR=
1.5 FOR SS304
1.5 FOR AL 2024 "O"
1.65 FOR AL 2024 AQ
3.0 FOR AL 2024 T4
3.0 FOR AL 2024 T3

FIG. 2C

| | $K_s$ | $K_f$ |
|---|---|---|
| SS 304 | 101600 | 11.7 |
| AL 2024 "O" | 26600 | 7.4 |
| AL 2024 AQ | 62390 | 12.0 |
| AL 2024 T4 | 70800 | 13.9 |
| AL 2024 T3 | 70900 | 15.9 |

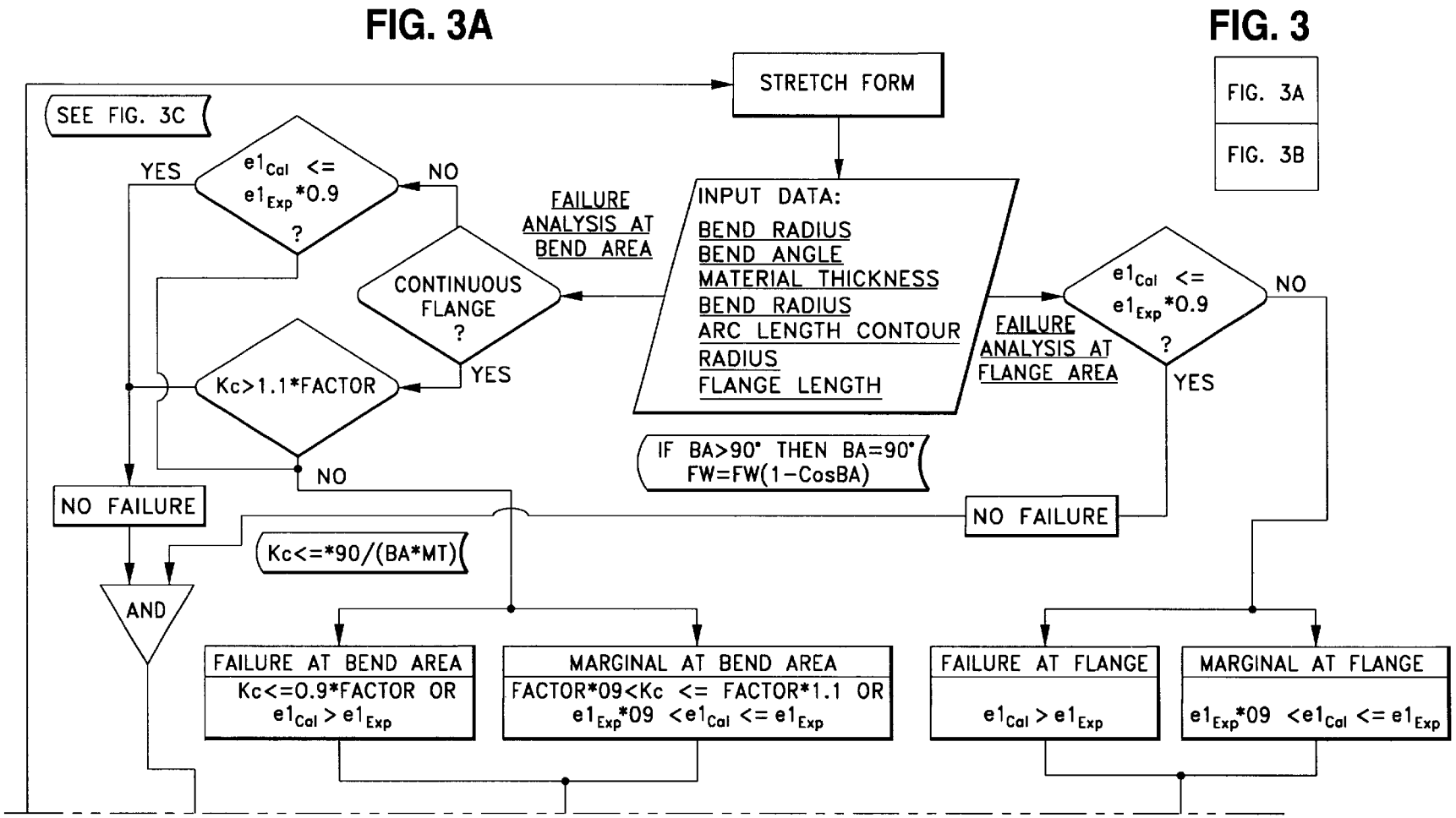
FIG. 3
FIG. 3A
FIG. 3B
FIG. 3A
STRETCH FORM
INPUT DATA:
BEND RADIUS
BEND ANGLE
MATERIAL THICKNESS
BEND RADIUS
ARC LENGTH CONTOUR
RADIUS
FLANGE LENGTH
FAILURE ANALYSIS AT FLANGE AREA
FAILURE ANALYSIS AT BEND AREA
CONTINUOUS FLANGE ?
NO
YES
e1Cal <= e1Exp*0.9 ?
Kc>1.1*FACTOR
IF BA>90° THEN BA=90° FW=FW(1-CosBA)
NO FAILURE
Kc<=*90/(BA*MT)
AND
SEE FIG. 3C
MARGINAL AT FLANGE
e1Exp*09 <e1Cal <= e1Exp
FAILURE AT FLANGE
e1Cal > e1Exp
MARGINAL AT BEND AREA
FACTOR*09<Kc <= FACTOR*1.1 OR e1Exp*09 <e1Cal <= e1Exp
FAILURE AT BEND AREA
Kc<=0.9*FACTOR OR e1Cal > e1Exp

| | $K_s$ | $K_f$ |
|---|---|---|
| SS 304 | 101600 | 2.80 |
| AL 2024 "O" | 26600 | 1.81 |
| AL 2024 AQ | 62390 | 2.90 |
| AL 2024 T4 | 70800 | 3.40 |
| AL 2024 T3 | 70900 | 3.80 |

FIG. 3C $e1_{cal}=0.6*FW^{1.2}*BR^{-0.8}*CR^{-0.8}$ $e2_{cal}=-0.07*FW^{0.6}*BR^{-0.4}*CR^{-0.3}$ IF $e2_{cal}<=-0.08$ THEN $e2_{cal}=-0.08$ $e1_{exp}=$ WHERE $X=e2_{cal}$ $0.5159-0.4798x+1.254^2x+2.2X^3$ FOR SS 304

$0.2095-0.0297X+5.7484^2X+13.4466X^8$ FOR AL 2024 "O"

$0.2193-0.2505X+8.022^2X+18.3069X^8$ FOR AL 2024 AQ $0.142-0.2327X+7.7338^2X+22.3734X^8$ FOR AL 2024 T4

$0.0617-0.0712X+7.6217^2X+29.2318X^8$ FOR AL 2024 T3

FIG. 3D

IF $CR<2.5$ $e1_{cal}=\ln(FW*(CR-FW)+1)$ $e2_{cal}=-0.4*e1_{cal}$

IF $CR>=2.5$ $e1_{cal}=0.44*FW^{0.5}*AL^{0.3}*CR^{-0.8}$ $e2_{cal}=-0.16*FW^{0.6}*AL^{0.4}*CR^{-0.9}$ IF $e2_{cal}<=-0.08$ THEN $e2_{cal}=-0.08$ $e1_{exp}=$ WHERE $X=e2_{cal}$ $0.5159-0.4798x+1.254^2x+2.2X^3$ FOR SS 304

$0.2095-0.0297X+5.7484^2X+13.4466X^8$ FOR AL 2024 "O"

$0.2193-0.2505X+8.022^2X+18.3069X^8$ FOR AL 2024 AQ $0.142-0.2327X+7.7338^2X+22.3734X^8$ FOR AL 2024 T4

$0.0617-0.0712X+7.6217^2X+29.2318X^8$ FOR AL 2024 T3

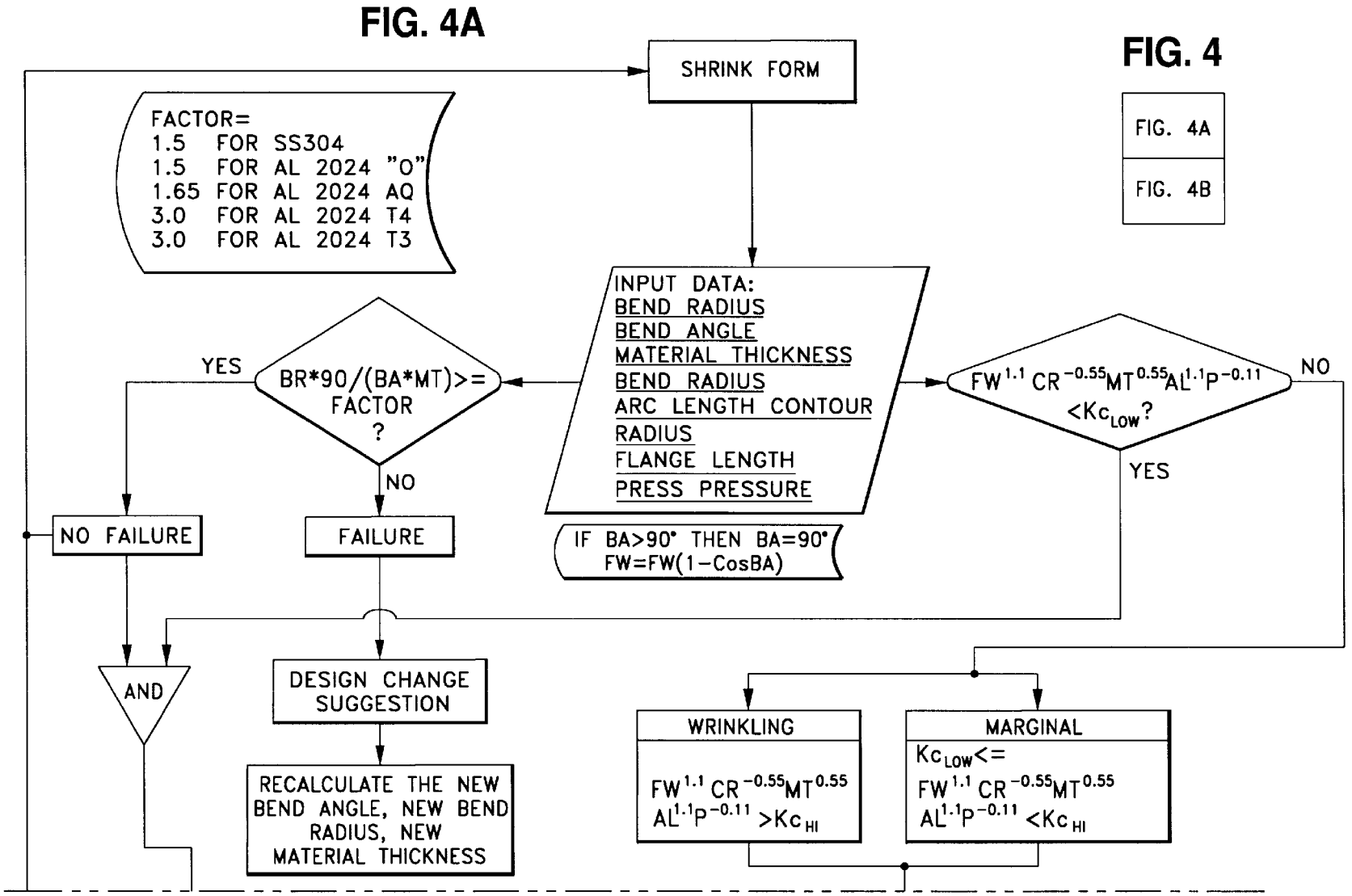
FIG. 4
FIG. 4A
FIG. 4B
FIG. 4A
SHRINK FORM
FACTOR=
1.5 FOR SS304
1.5 FOR AL 2024 "O"
1.65 FOR AL 2024 AQ
3.0 FOR AL 2024 T4
3.0 FOR AL 2024 T3
INPUT DATA:
BEND RADIUS
BEND ANGLE
MATERIAL THICKNESS
BEND RADIUS
ARC LENGTH CONTOUR
RADIUS
FLANGE LENGTH
PRESS PRESSURE
IF BA>90° THEN BA=90°
FW=FW(1-CosBA)
BR*90/(BA*MT)>=
FACTOR
?
YES
NO
NO FAILURE
FAILURE
$FW^{1.1}\ CR^{-0.55}MT^{0.55}AL^{1.1}p^{-0.11}$
$<Kc_{LOW}$?
NO
YES
AND
DESIGN CHANGE
SUGGESTION
RECALCULATE THE NEW
BEND ANGLE, NEW BEND
RADIUS, NEW
MATERIAL THICKNESS
WRINKLING
$FW^{1.1}\ CR^{-0.55}MT^{0.55}$
$AL^{1.1}p^{-0.11}>Kc_{HI}$
MARGINAL
$Kc_{LOW}<=$
$FW^{1.1}\ CR^{-0.55}MT^{0.55}$
$AL^{1.1}p^{-0.11}<Kc_{HI}$

| | $K_s$ | $K_f$ |
|---|---|---|
| SS 304 | 101600 | 2.80 |
| AL 2024 "O" | 26600 | 1.81 |
| AL 2024 AQ | 62390 | 2.90 |
| AL 2024 T4 | 70800 | 3.40 |
| AL 2024 T3 | 70900 | 3.80 |

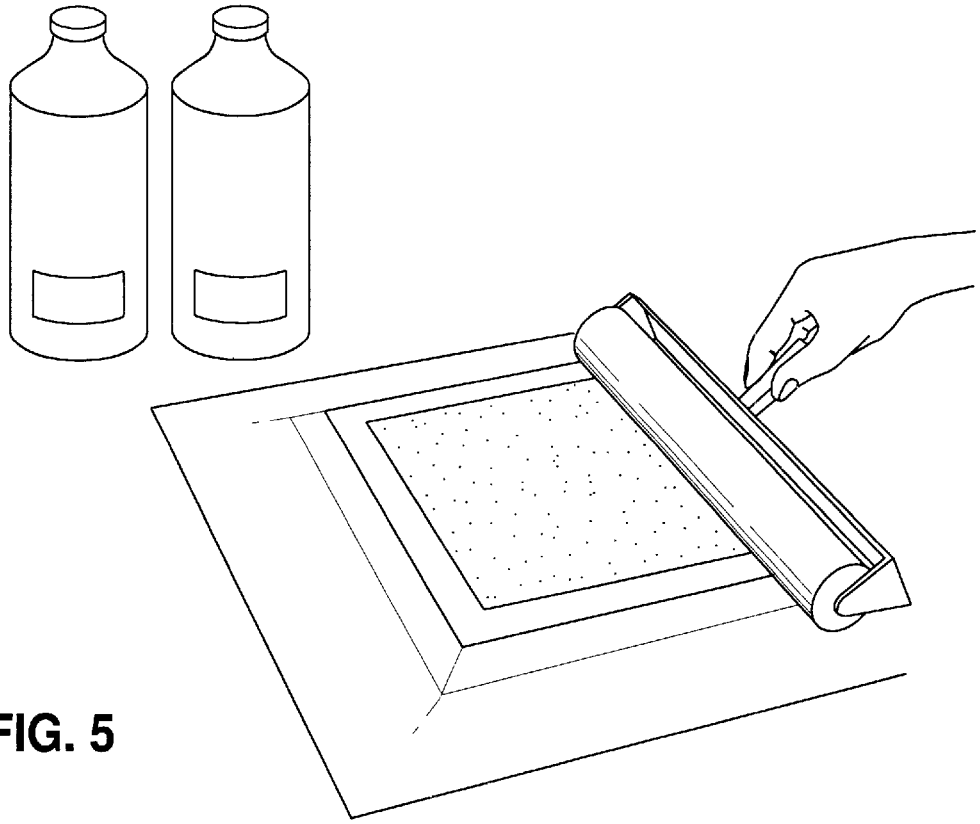
FIG. 5
FIG. 6
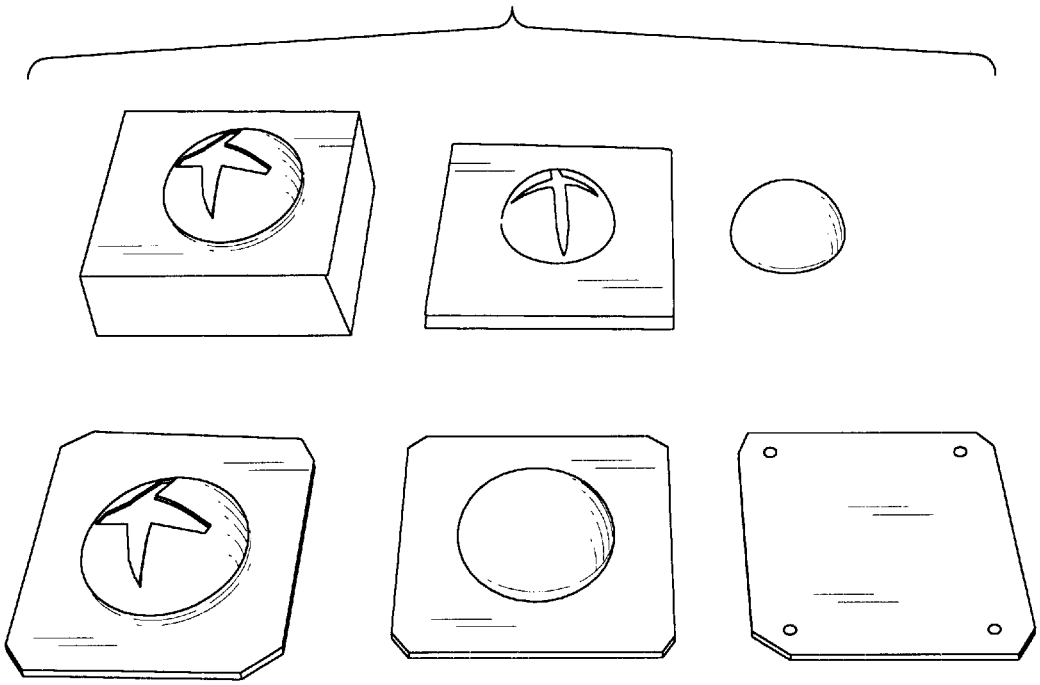

FLUID CELL PROCESS MODELING

STATEMENT RE: FEDERALLY SPONSORED RESEARCH/DEVELOPMENT

This invention was made with Government support under contract F33615-93-C-5318 awarded by the Unites States Government. The Government has certain rights in this invention.

FIELD OF THE INVENTION

The present invention relates generally to workpiece design for press forming operations, and more particularly to a method for selecting suitable workpiece materials utilizing customized strain and bending correlations.

BACKGROUND

As is generally known, many consumer and-industrial goods are constructed by press forming a relatively pliable workpiece material into the desired product shape. For example, refrigerators, ovens, storage cabinets, beverage containers, tool chests, and automobile body parts are often constructed by press forming aluminum or steel sheets. Likewise, many airplane components, such as the fuselage, chair frames, and structural support members are often constructed by forging or press forming aluminum sheets or blanks.

In many cases, it is critical that the workpiece material will not rupture or yield when it is formed into the desired shape. As such, the workpiece material must be sufficiently ductile, the workpiece shape must be compatible with the types of bends that will be made, and there must be a sufficient quantity of workpiece material so it can be stretched and manipulated into the final shape. In addition, designers often prefer to minimize the size and weight of the workpiece. For instance, a smaller and lighter workpiece can be an important design parameter, such as with airplane and rocket components. Furthermore, a smaller and lighter workpiece can reduce per unit material cost, and may reduce the number of post-forming operations that are required, such as trimming excess material.

While the art of selecting and designing workpiece materials is very old, the process can be very expensive, time consuming, and inaccurate. In some cases, designers may refer to various engineering manuals to evaluate the formability of a particular material. If the product is formed from a common material, substantial information may be available regarding the material strength and ductility. For common materials, general bending correlations may also be available for predicting strain when the workpiece is bent and stretched into typical shapes. This approach can be inaccurate or impossible however, if the finished product is formed from a relatively new or rare material. Moreover, standard strain correlations can be inaccurate if the workpiece bends are different from those used to develop the correlations.

In addition to the above difficulties, complex material properties are often difficult to predict. For example, strain correlations may not be available for predicting the combined strain from multiple bends disposed about the workpiece. Combined strain can be a problem when the strain from the respective bends do not cause fracture when considered in isolation, but their combined strain leads to failure in the workpiece. Similarly, standard engineering manuals often do not have accurate correlations for predicting the tendency for a workpiece to spring back after press forming. Thus, the workpiece final shape may deviate from the intended shape when this tendency is not accounted for.

To address these problems, it is known in the art to select workpiece materials by experimentation. Experimental methods normally involves bending multiple workpiece samples into the desired product shape so that an optimum workpiece design can be determined by trial and error. While this approach can provide accurate information regarding strain properties and the tendency to spring back, it can also be expensive and time consuming. For instance, extensive testing is generally required for new materials or when the workpiece is formed into relatively unique shapes. As such, budgetary constraints may limit the amount of time and money for workpiece testing, and a less than optimum design may be selected for expediency. In addition, even if a near optimum workpiece design can be developed, the test data may not be useful if the product shape is subsequently modified. As a result, testing may have to be repeated when the finished product changes.

In view of the above complexities, a primary object of the present invention is to provide a more accurate method for determining workpiece formability using customized strain and bending correlations for the workpiece material.

Another object of the present invention is to provide a method for predicting the extent of workpiece spring back after press forming.

Yet object of the present invention is to provide a method for determining the compounded strain resulting form multiple bends.

Moreover, another object of the present invention is to provide a method for determining bend angles to predict whether a workpiece may be formed in one step forming operation.

Still another object of the present invention is to provide a method for determining workpiece formability which minimizes the time and expense for workpiece testing.

These and other objects of the present invention will become apparent from the disclosure which now follows.

BRIEF SUMMARY OF THE INVENTION

The present invention is a method for selecting a suitable workpiece having a material composition and a thickness for forming an article. The method includes the steps of selecting a workpiece, obtaining a yield strain for the workpiece material, and determining whether the article has at least one straight bend wherein each straight bend defines a respective straight bend axis. If the article has at least one straight bend, the user inputs a straight bend radius and a straight bend angle for each straight bend, and calculates a straight bend strain across each respective straight bend axis. This calculation can be accomplished utilizing a customized strain correlation for the workpiece material as developed from strain test data of workpiece samples. The straight bend strain for each bend can then be compared to the workpiece yield strain. If the straight bend strain at least equals the material yield strain, the workpiece can be classified unsuitable, and an alternative workpiece can be selected. In this case, the evaluation can be repeated for the alternative workpiece; however, the same strain correlation can be utilized if the same work piece material is selected. If on the other hand, the straight bend strain is less than the material yield strain, the workpiece can be classified suitable, pending the outcome of other workpiece evaluations.

The method also determines whether the article has at least one stretch flange defining a corner axis and a centerline axis. If so, the user inputs a bend angle, a bend radius, a bend arc length, a flange width, and a contour radius for each stretch flange, and calculates a stretch flange corner strain across the corner axis and a stretch flange bottom center strain across the centerline axis for each stretch flange. In the preferred embodiment, this calculation is accomplished utilizing customized strain correlations for the workpiece material as developed from strain test data of workpiece samples. The calculated strains are then compared with the workpiece yield strain to determine workpiece suitability.

The method also calculates a combined stress from multiple step bends. If multiple steps are present, the method determines the location of maximum strain for each bend and adds the strains at each of the locations where a maximum strain is present. The total strain at each of the respective locations can then be compared to the material yield strain for determining the suitability of the workpiece material.

The method of the present invention can also determine the suitability of a workpiece having a shrink flange defining a corner axis and a centerline axis. If a shrink flange is present, the user inputs an arc length, a bend radius, a bend angle, a bend contour radius, a flange width, and a press forming pressure for each shrink flange, and calculates a bend strain across the corner axis at the bend line, and a bottom center strain across-the centerline axis. The strains can be calculated according to customized strain correlations developed from strain test data of workpiece samples. The straight bend strain can then be compared with the material yield strain and the bottom center strain can be compared with a material buckle strain for determining suitability of the workpiece material.

The method of the present invention can also determine spring back deformation of a workpiece material. Two types of spring back can be evaluated. First, straight bend spring back can be determined by inputting a workpiece thickness, bend angle, bend radius, and press forming pressure, and calculating the straight bend spring back deformation according to a customized straight bend spring back correlation developed from testing workpiece samples. Second, curved bend spring back can be determined by inputting a workpiece thickness, bend angle, bend radius, contour radius, and press forming pressure, and calculating the curved bend spring back deformation according to a customized curved bend spring back correlation developed from testing workpiece samples. The as-formed dimensions of the workpiece can then be adjusted for the calculated spring back to determine suitability of the workpiece and the press forming procedure.

In the above manner, the formability of a workpiece can be determined based on customized strain correlations developed for the specific material and the types of bends that will be formed. In addition, once the correlations are developed, the correlations can be used to select a workpiece for other shapes formed from the same material. Thus, testing does not have to be repeated once the correlations are developed for a particular material. Moreover, the method can be used to predict workpiece spring back for designing the workpiece and the press forming procedures.

BRIEF DESCRIPTION OF THE DRAWINGS

Illustrative and presently preferred embodiments of the present invention are shown in the accompanying drawings in which:

FIGS. 2A–2C are flow diagrams of a tooling operation submenu for sheet metal forming of a straight bend;

FIG. 5 is a perspective view of a electro-etching equipment with a power unit, a roller, a stencil and electrolytes;

FIG. 6 is a perspective view of dies each having a semi-spherical cavity therein;

DETAILED DESCRIPTION OF THE INVENTION

Figure 1:
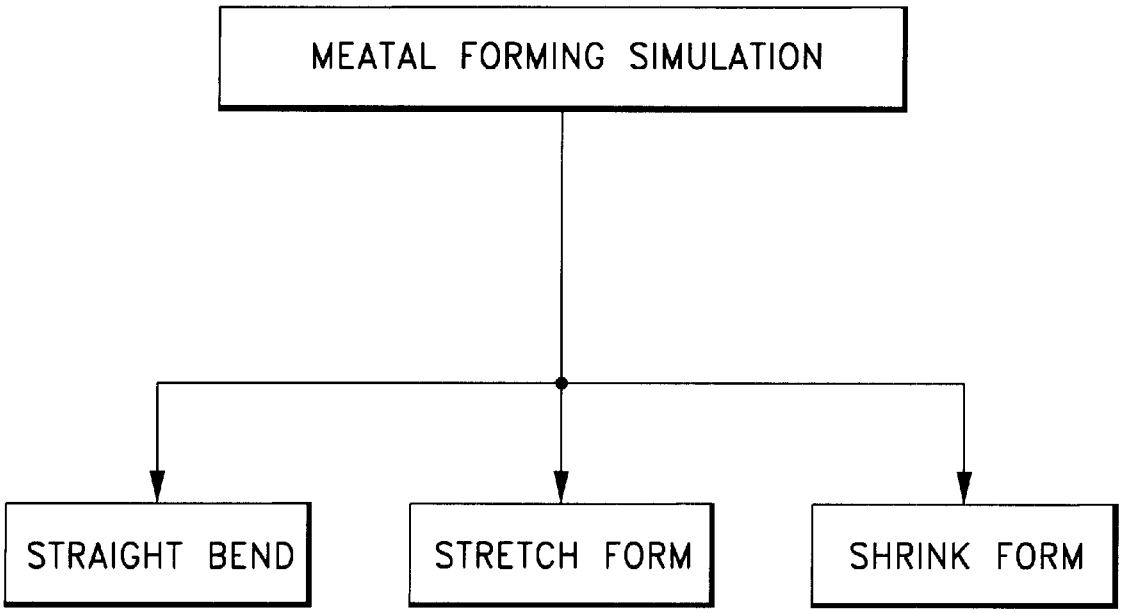
FIG. 1 is a flow diagram of a sheet metal forming software constructed in accordance with a preferred embodiment of the present invention and defining a main menu and tooling category submenus therein.
Figure 2A:
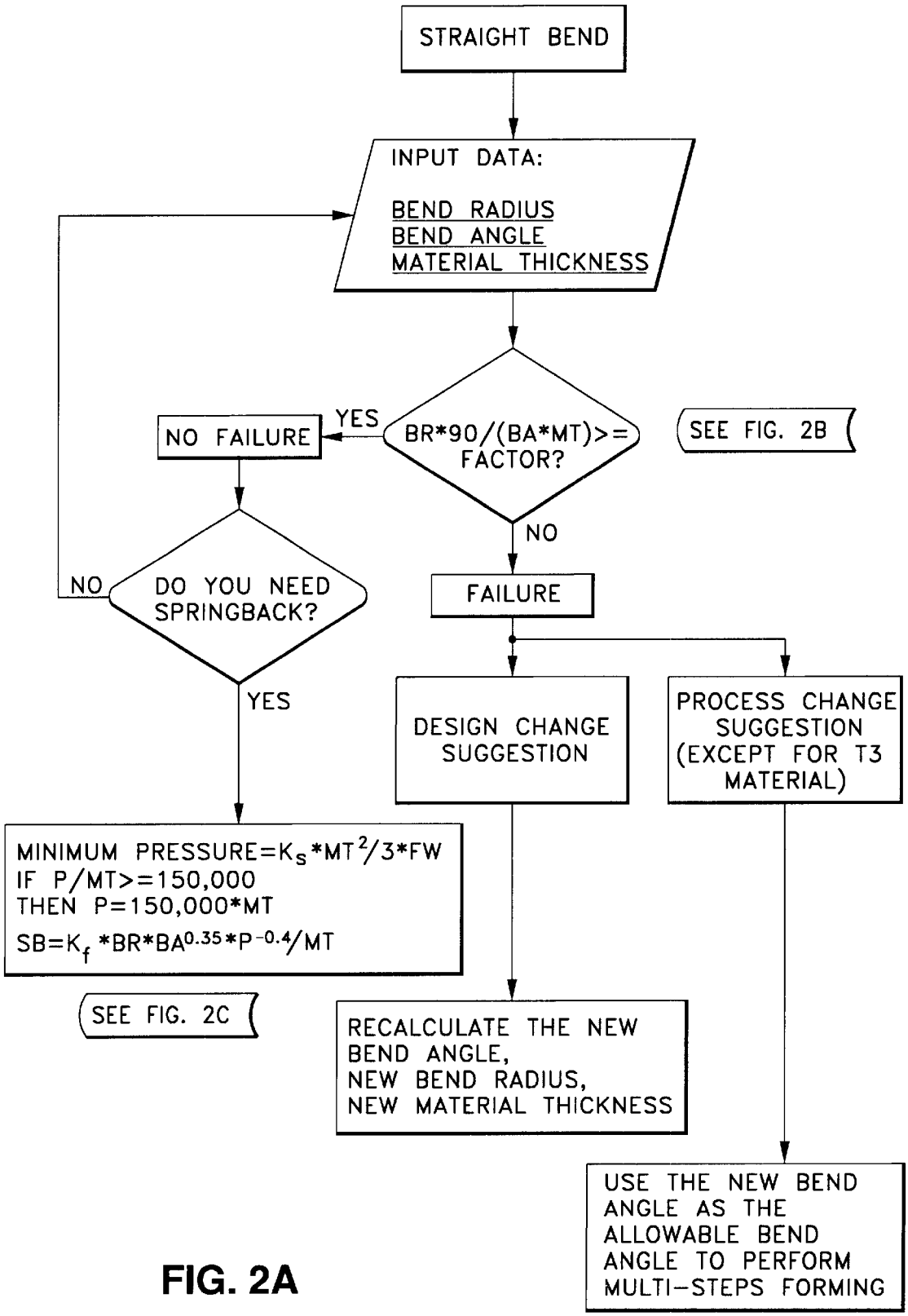
Figure 3B:
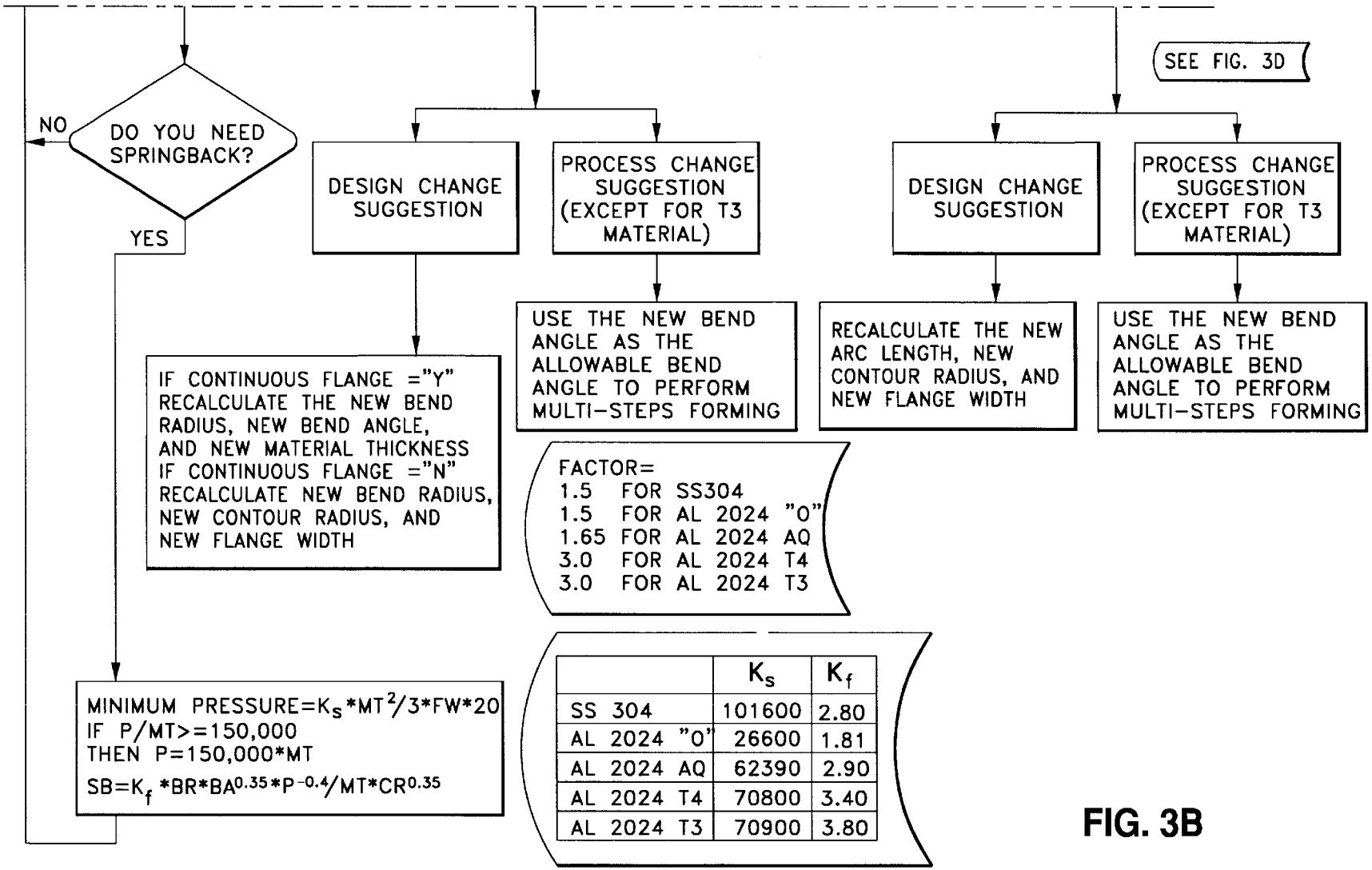
FIG. 3 show flow diagrams of the tooling operation submenu for sheet metal forming of a stretch form.

Referring now to the drawings wherein the showings are for purposes of illustrating preferred embodiments of the present invention only, and not for purposes of limiting the same, FIGS. 1–4B are flow diagrams outlining a method for determining workpiece formability 10. It is contemplated that the computations and decisional steps of the method can be incorporated within a computer software program, however, it is also recognized that these steps can also be performed manually or semi-manually, such as with a programmable hand calculator.

Referring now to FIGS. 1, 16, 20, and 38, the method 10 of the present invention determines the suitability of a workpiece 12 for forming the shape of a finished product 14. In particular, the method 10 can be adapted for analyzing yield failure from individual bends, buckling failure, and failure resulting from excessive spring back. The method 10 commences with the main menu 16 in which the user selects the types of bends that will be formed into the workpiece 12. The type of bends can be manually input with a key board or other standard input device (not shown) or the method 10 can be incorporated in software such that the bend information is downloaded directly from other computer aided design (CAD) programs. In the preferred embodiment, the user can select straight bends 18, stretch forming (concave) flanges 20, and/or shrink forming (convex) flanges 22. It is recognized, of course, that the method 10 can be adapted for other types of bends and manipulation of the workpiece, such as for straight bends alone, or for simple stretching of the workpiece.

The type of bends selected dictates the types of workpiece failure that will be analyzed. If the workpiece 14 will be formed with at least one straight bend 18 or at least one stretch flange 20, the yield strain ($e_y$) of the material will be determined, and an as-formed strain will be calculated at critical locations on the workpiece 14 as described below. In this manner, the as-formed strain can be compared with the yield strain ($e_y$) to determine if the workpiece 14 will yield when formed into the desired shape. Similarly, if the workpiece 14 will be formed with a shrink flange 22, a maximum wrinkle stress will be determined and an expected as-formed stress of the workpiece material will be calculated at critical locations for comparison with the maximum wrinkle stress.

Determining the Yield Strain For The Workpiece Material

As shown in FIGS. 5–12, the strain behavior of a workpiece material can be determined by incrementally stretching a planar test specimen 24, and measuring the resulting strain on the specimen 24. For this test, a grid pattern 26 can be printed on a surface of the specimen 24 so the distance between grid lines can be compared before and after stretching. The grid 26 can be printed by any conventional printing form such as electrochemical sketching with an Lectrotech V-45A sketching device. As shown in FIGS. 5 and 6, the specimen 24 can be sketched with a semi-circular grid 26 for a semi-spherical stretching test. The grid can comprise two or more circles 30 having a diameter of about 0.1 inch. It is recognized, of course, that other types of in grids can be printed for other types of strain testing. For example, a rectangular shaped grid can be useful for measuring strain when making linear folds in the specimen 26.

Once the grid 26 is sketched, the specimen 24 can be gradually stretched into a generally semi-spherical shape until it fractures. For this type of strain test, the specimen 24 can be placed on a die 32 having a semi-spherical cavity 34 such that the specimen 24 covers the cavity 34. The sample can then be pressed into the cavity by a press (not shown) or similar device having a variably adjustable press pressure. The press should have a semi-spherical mandrel (not shown) sized to fill the cavity 34 so the press mandrel will not puncture the specimen 24 prior to fracture. The cavity 34 can also be sized with a diameter of 4 inches. This sizing allows sufficient stretching to reach the yield strain ($e_y$) of many commercially available sheet metals. It is, of course, recognized that the die cavity 34 and press mandrel can be larger for thicker or more pliable materials, or smaller for less ductile or thinner materials.

Once the specimen 24 is stretched, the radial strain $e_1$ and hoop strain $e_2$ can be measured by inspecting the grid 26 with an eyepiece. Calibrated measuring tape can also be placed adjacent to the grid lines 36 for measuring the strains $e_1$, $e_2$. The uniform thickness strain $e_3$ can be measured using a micrometer. The accuracy of the measurements should be within about 2 percent of the maximum distance between grid lines, or 0.002 inches when the circles 30 are sketched with diameter of 0.1 inch.

Figure 7:
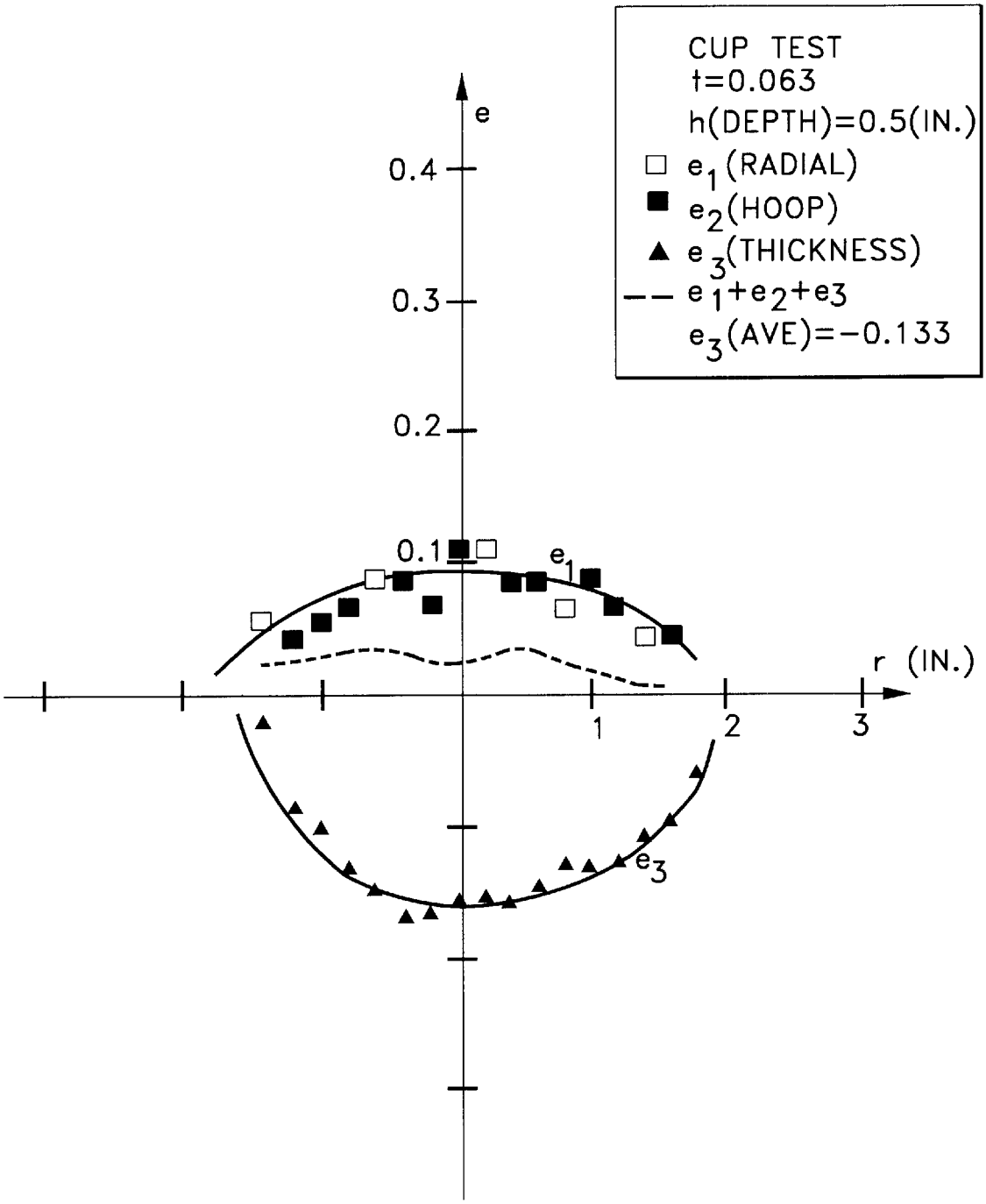
FIGS. 7–9 are graphs portraying strain distributions on the surface of a formed cup at different depths.
Figure 8:
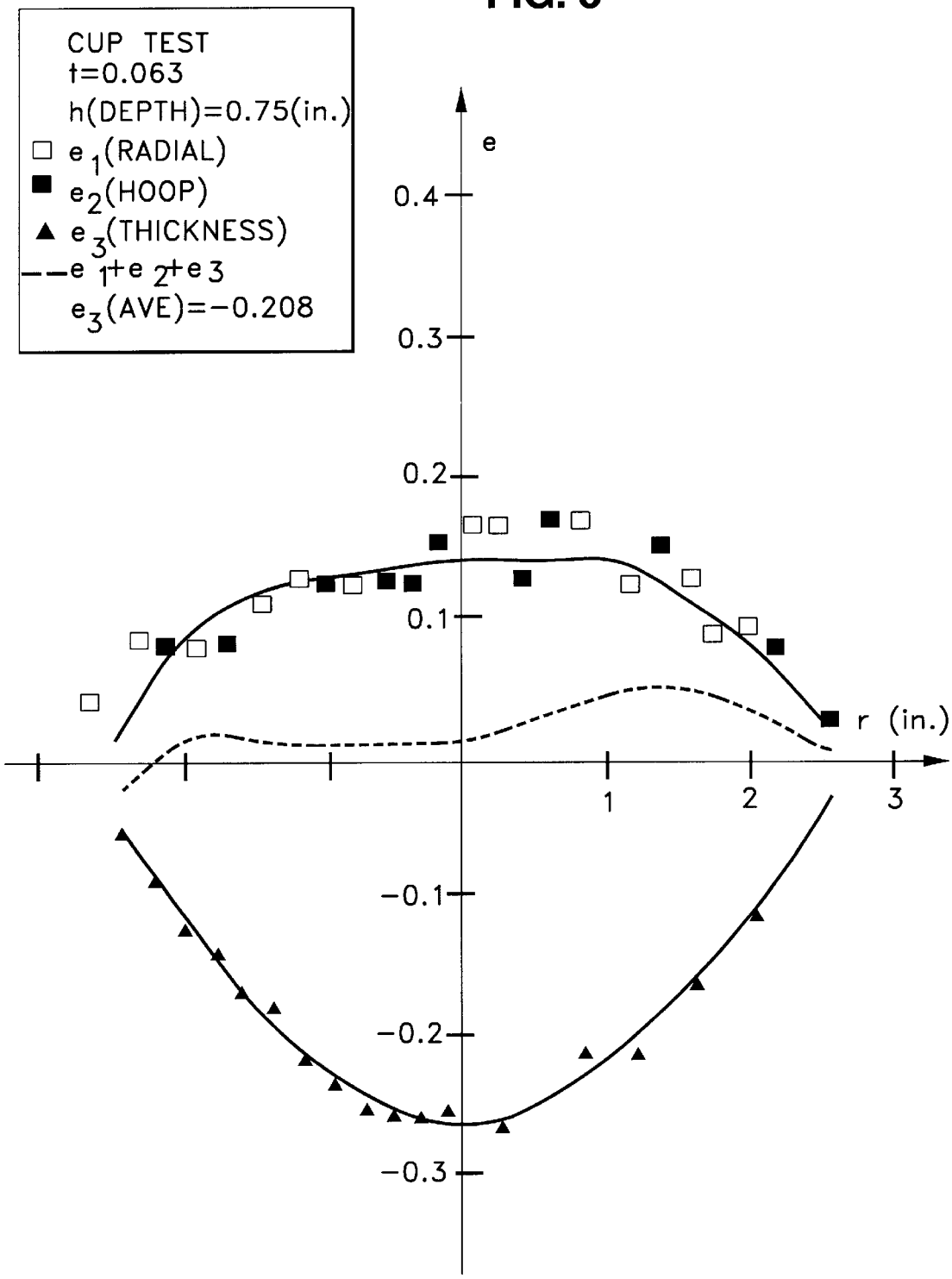
Figure 9:
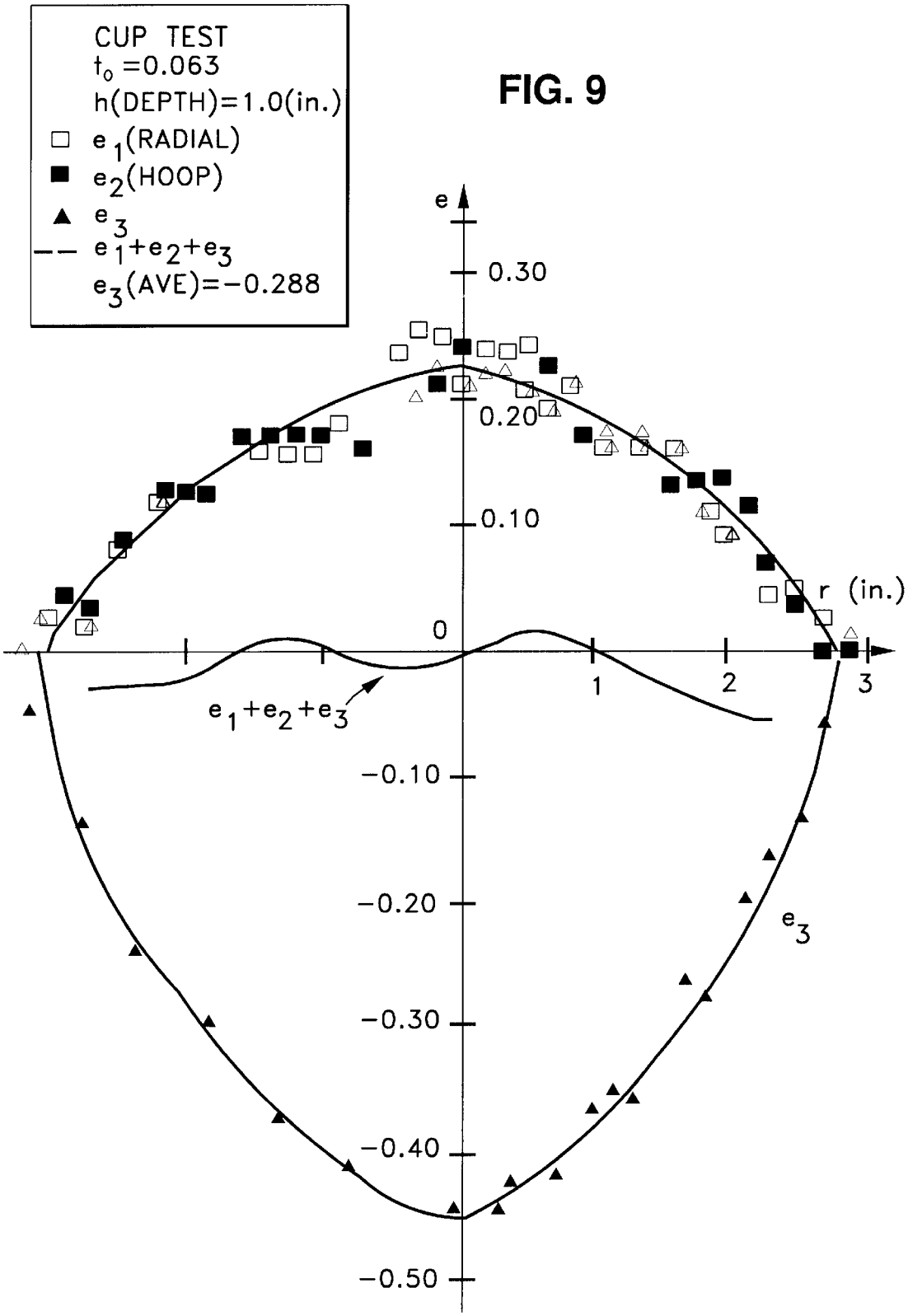

Referring now to FIGS. 7–9, the measured strain can be plotted as a function of penetration depth (h) within the die cavity 34. The radial distance (r) indicates the distance of the strain measurement from the pole position 38 of the cavity 34. The experimental values of $e_1$ and $e_2$ shown in FIGS. 7–9 are equal, indicating that the surface deformation is isotropic. The broken lines 40 represent the summation of the radial ($e_1$), hoop ($e_2$), and uniform thickness ($e_3$) strains. According to the theory of plasticity, the summation of the three strains $e_1$, $e_2$, $e_3$ should be zero; however, the measured strains may deviate slightly from zero summation due to experimental and measurement error.

Figure 10:
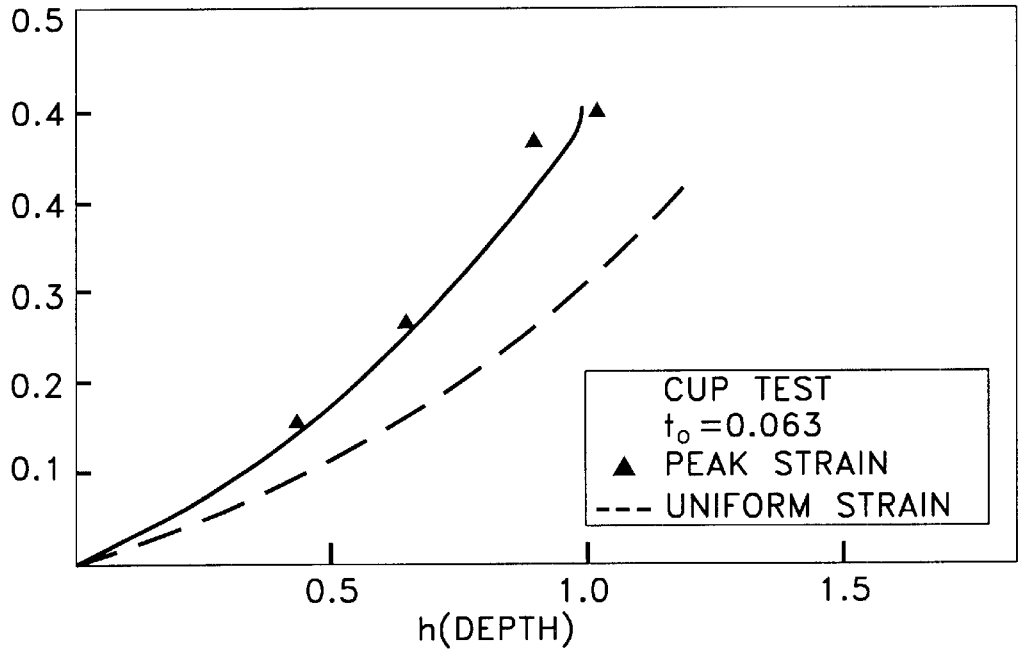
FIG. 10 illustrates a graph of a peak strain versus the depth of the cup.

Referring again to FIGS. 7–9, the strain distribution of the test specimen can be fairly uniform across the diameter of the cavity 34 when the penetration depth is relatively shallow, however, a peak in strain becomes evident when the penetration depth (h) increases. Eventually, with increasing penetration depth, the specimen 24 necks to such an extent that fracture occurs. As shown in FIG. 10, peak strain can be correlated to the uniform, or average strain at small values of "h". Thus, fracture can be predicted when the peak strain exponentially increases relative to the uniform strain, that is, when the peak strain has a nearly vertical slope when plotted against the penetration depth.

Figure 11:
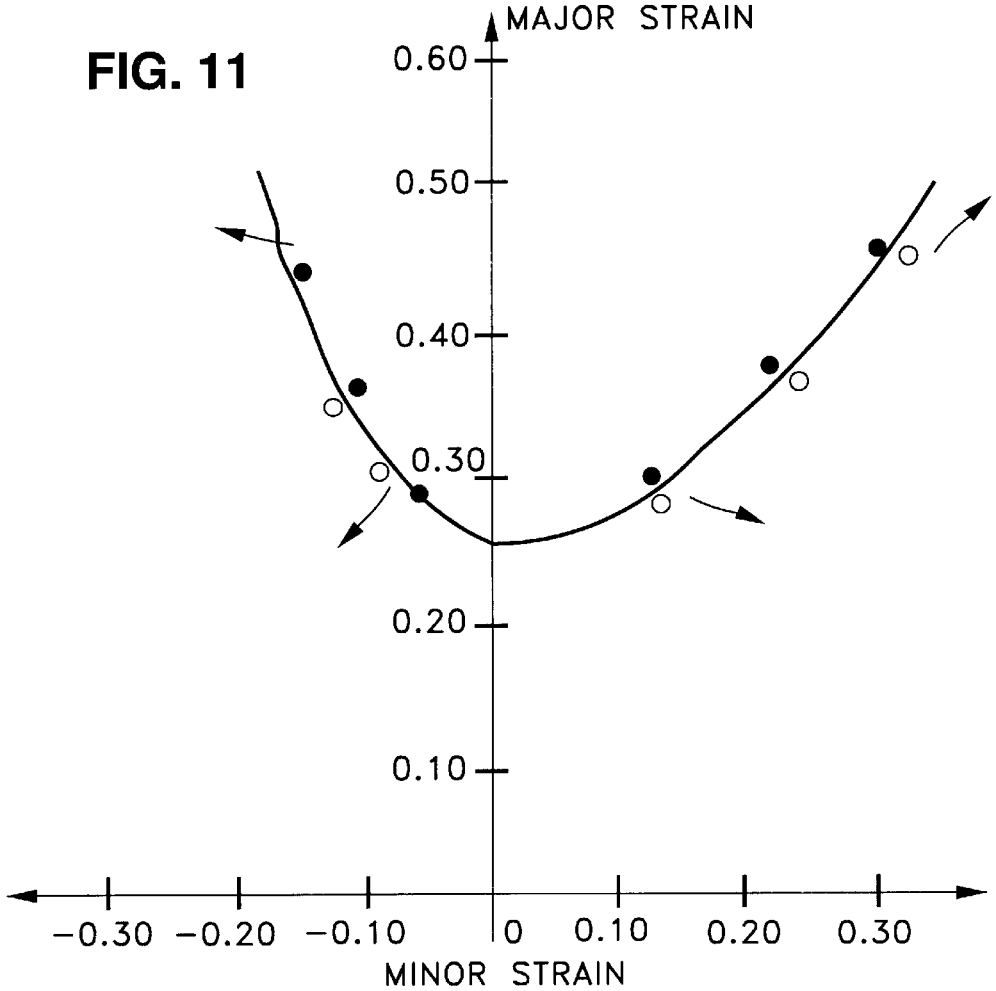
FIG. 11 is a graph portraying a plot of a major strain and a minor strain used to develop a Forming Limit Diagram (FLD)
Figure 12:
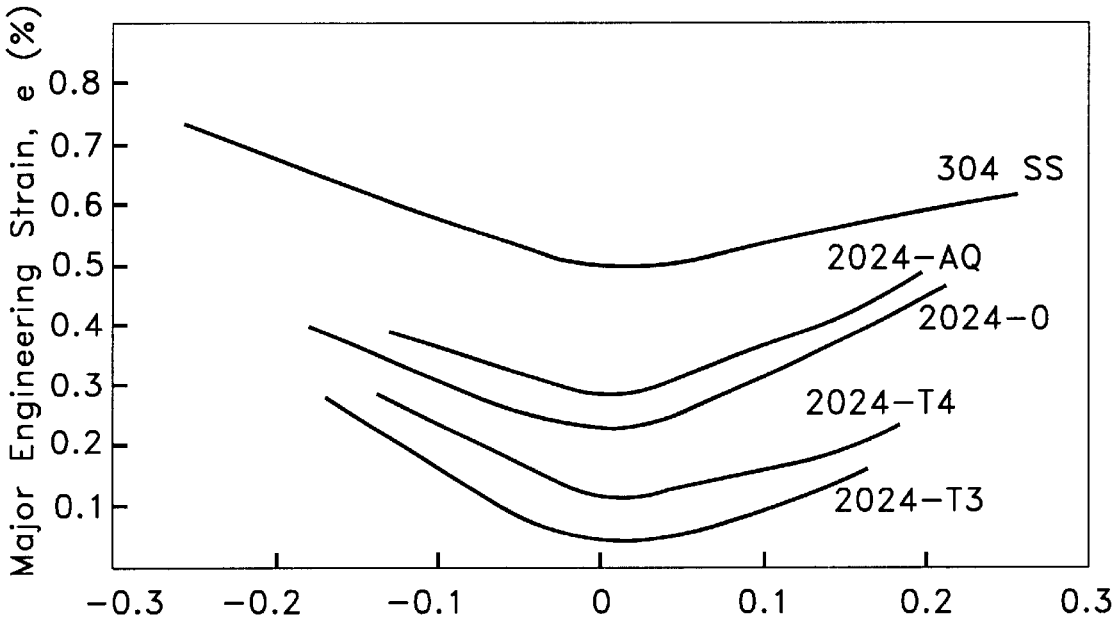
FIG. 12 is a graph portraying the FLD for 2024 aluminums in different tempers and 304 stainless steels in anneal conditions.

Referring now to FIGS. 11 and 12, a form limiting diagram (FLD) can be developed for various workpiece materials by plotting major strain versus minor strain. The major and the minor strain may be measured experimentally from the workpiece 12. Such measurement may be facilitated since the thickness is at a constant with varying width. When the major strain and minor strain are presented in this manner, an as-formed strain can be calculated at critical locations on the workpiece 12 and then superimposed on the FLD diagram to determine the success or failure of the workpiece 12. For instance, when the as-formed strain lies on or above the parabolic curve of FIG. 11, the workpiece 12 can be classified unsuitable due to the likelihood of fracture.

Straight Bending Strain

Figure 16:
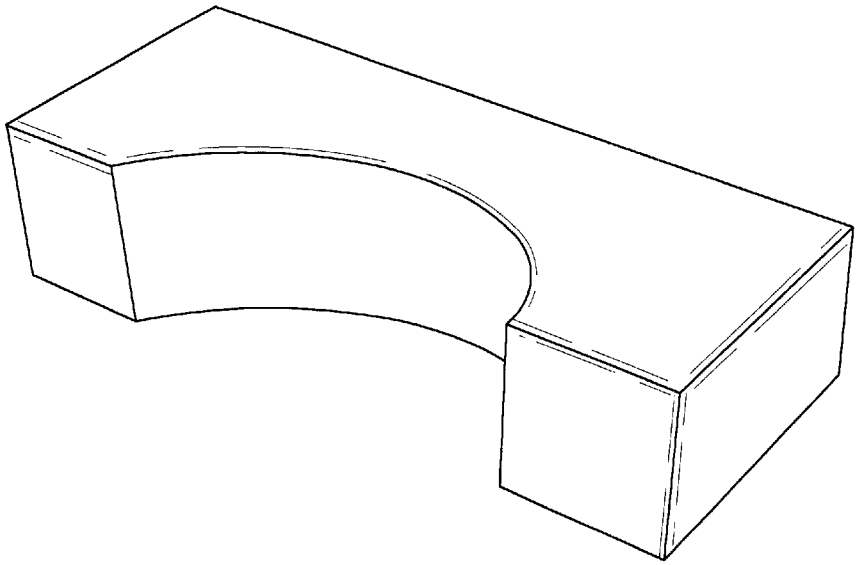
FIG. 16 is a perspective view of a stretch forming die.

Referring to FIG. 16, straight bends can be classified as non-curved folds defining a longitudinal bend straight bend axis a—a, a bend angle (⊖), and a bend radius (BR). For these bends, failure is most likely to occur along the bend axis a—a. As such, the expected strain can be calculated along the bend axis a—a in the middle of the workpiece thickness according the following straight bend correlation:

$$e_{sb}=K(t)^{a}(BR)^{b}(\ominus)^{c}, \quad \text{(I)}$$

where ($e_{sb}$) is the straight bend strain along the bend axis, (K) is a strain constant for the material, (t) is the workpiece thickness, (a) is a thickness constant, (BR) is the straight bend radius, (b) is a straight bend radius constant, (⊖) is the straight bend angle, and (c) is a straight bend angle constant. The material thickness (t), bend radius (BR), and bend angle (⊖) can be input by the user or downloaded as part of the standard output from a standard CAD software program.

Figure 13:
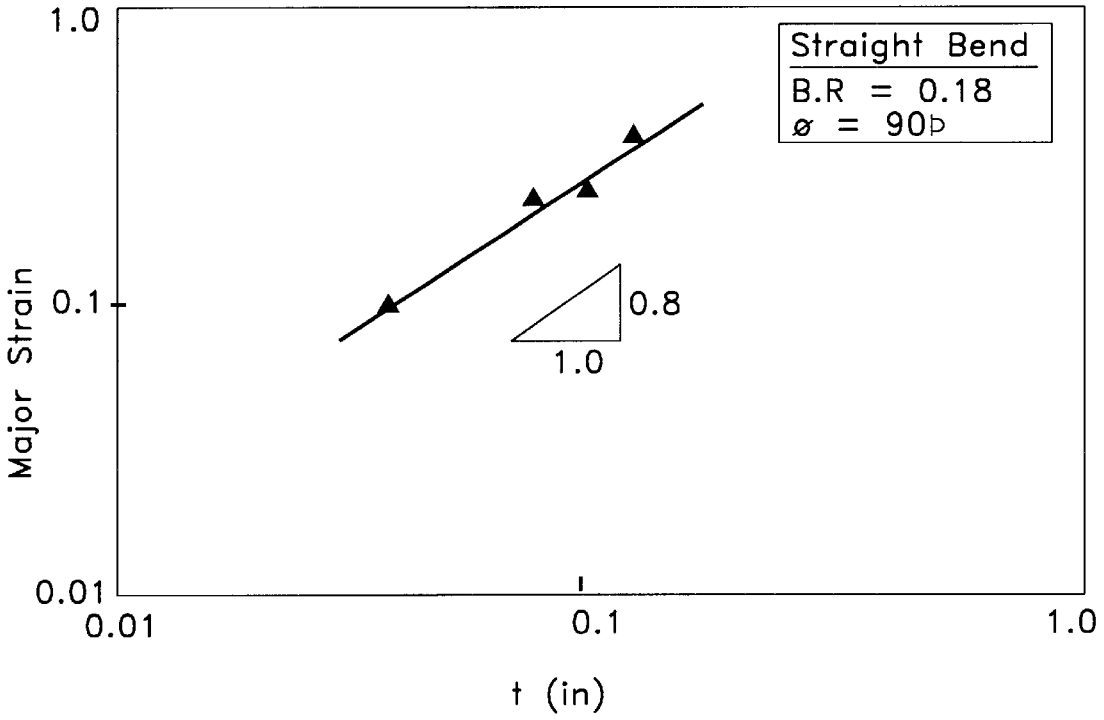
FIG. 13 illustrates a graph of a strain versus a thickness for the straight bend.

The constants (a), (b), and (c) are determined by strain testing samples of the material. For example, the constant (a) can be obtained by bending samples having unequal thickness (t) to substantially equivalent respective bend angles (⊖) and bend radii (BR). The resulting strain of the samples is then measured across the bend axis a—a. The measured strain is next plotted on a log-log scale as a function of thickness to develop a first logarithmic correlation wherein the constant (a) corresponds to a slope characteristic of the logarithmic correlation. An example is shown in FIG. 13 in which the constant (a) is 0.8/1.0=0.8.

Figure 14:
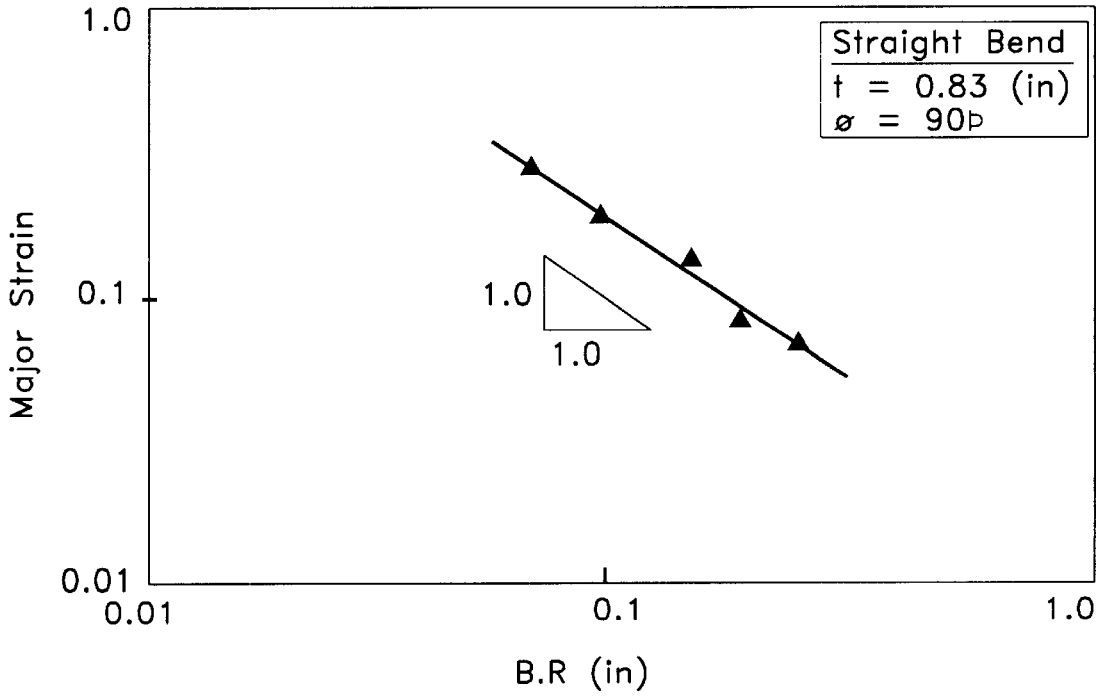
FIG. 14 illustrates a graph of the strain versus a bend radius for the straight bend.

Similarly, the constant (b) can be obtained by bending samples having the same thickness (t) into equivalent bend angles (⊖) but different bend radii (BR). The measured strain across the bend axis a—a for each sample can then be used to develop a second logarithmic correlation of strain relative to bend radii (BR) wherein the constant (b) corresponds to a slope characteristic of the second logarithmic correlation. An example is shown in FIG. 14 wherein the constant (b) is −1.0/1.0=−1.0.

Likewise, the constant (c) can be obtained by bending samples having equivalent thickness (t) to respective unequal bend angles (⊖) having equivalent bend radii (BR). The measured strain across the bend axis a—a for each sample can then be used to develop a third logarithmic correlation of strain relative to bend angle wherein the constant (c) corresponds to a slope characteristic of the third logarithmic correlation. An example is shown in FIG. 15 wherein the constant (c) is 1.0/.1.0=1.0 for bend angles less than 80 degrees and 0 for bend-angles greater than 80 degrees.

The constant K may be determined by experiment based on the equation (I). More specifically, the values of "a", "b" and "c" may be calculated using FIGS. 14–16. Thereafter, the value of K may be calculated using the experimental data. For instance, the thickness (t) and the bend radii (BR) may be maintained as constants with varying bend angle (⊖) until the workpiece 12 reaches fracture. By measuring the critical strain at the fracture point and substituting in equation (I) for $e_{sb}$, t, BR and ⊖, the value of k may be calculated. Thus, the value of K may be based not on a single test value, but on a best-fit method for series of tests. Therefore, this calculation of the constant K may produce the following values for the materials 2024 aluminum and 304 stainless steel 304:

| Material/Condition | k |
|---|---|
| 304 annealed | 2.0 |
| 304 1/4 hard | 2.0 |
| 304 1/2 hard | 3.0 |
| 304 full hard | 6.0 |
| 2024-0 | 2.0 |
| 2024-AQ | 2.0 |
| 2024-T4 | 4.0 |
| 2024-T3 | 4.0 |

Figure 15:
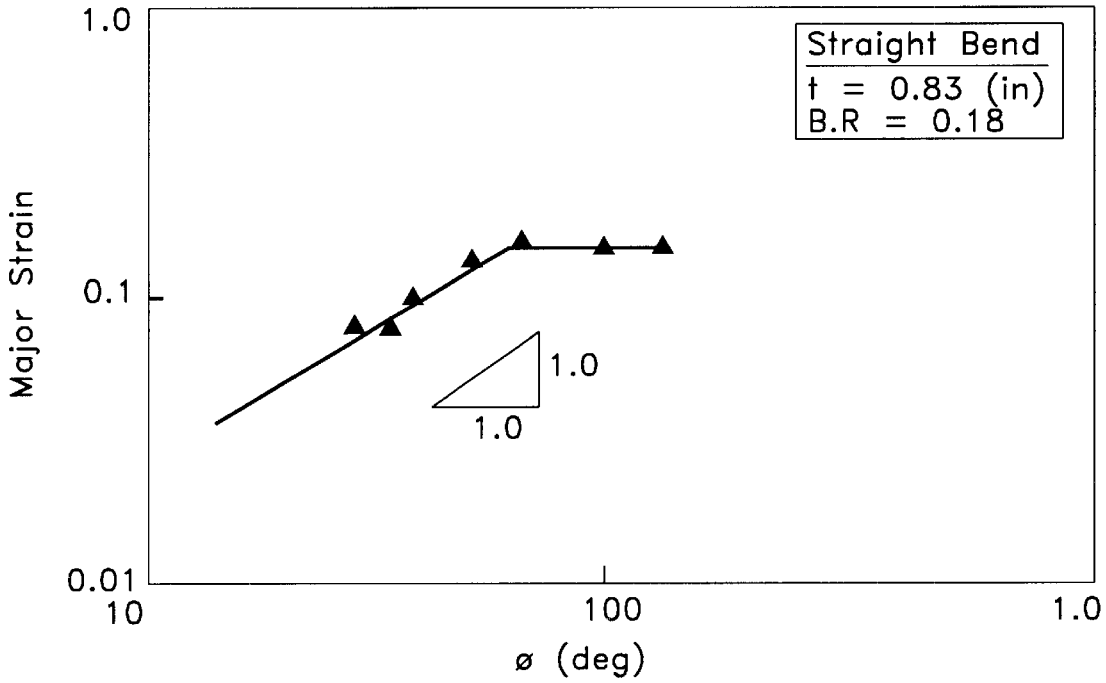
FIG. 15 illustrates a graph of the strain versus a bend angle for the straight bend.

Thus, for the material described in FIGS. 13–15, equation (I) can be written as:

$$e_{sb}=0.22(t)^{0.8}(BR)^{-1}(BA), \text{ for } BA \text{ less than 80 degrees; and}$$

$$e_{sb}=-0.0022(t)^{0.8}(BR), \text{ for } BA \text{ greater or equal to 80 degrees}$$

With the constants K, a, b, and c determined, the strain ($e_{sb}$) can be calculated across the straight bend axis a—a according to the straight bend correlation (I). The resulting value can then be compared with the material yield strain ($e_y$) as indicated by the FLD diagram. In this manner, the workpiece can be classified as potentially suitable if the straight bend strain is less than the material yield strain. In contrast, if the straight bend strain ($e_{sb}$) is greater than the material yield strain ($e_y$), the workpiece can be classified unsuitable, and an alternative workpiece can be selected and evaluated according to the same process. The testing process however, does not have to be repeated if the same workpiece material is selected.

Stretch Flange Strain

Figure 17:
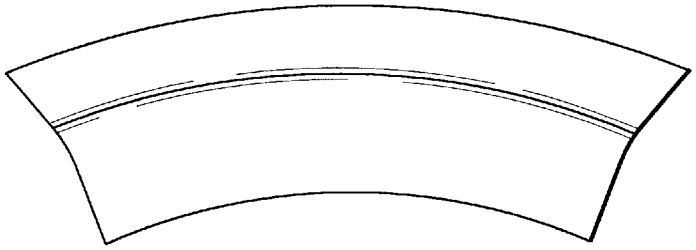
FIG. 17 is a perspective view of a stretch flange specimen.
Figure 18:
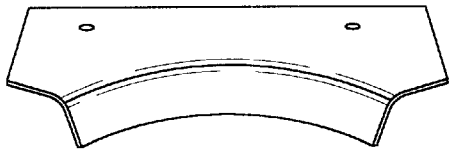
FIG. 18 is a perspective view of the stretch flange specimen with a fracture at the bottom center thereof.
Figure 19:
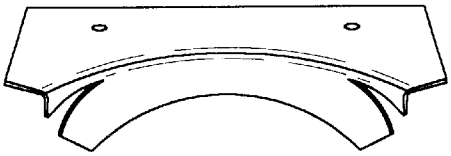
FIG. 19 is a perspective view of the stretch flange specimen with a fracture at the corner thereof.
Figure 20:
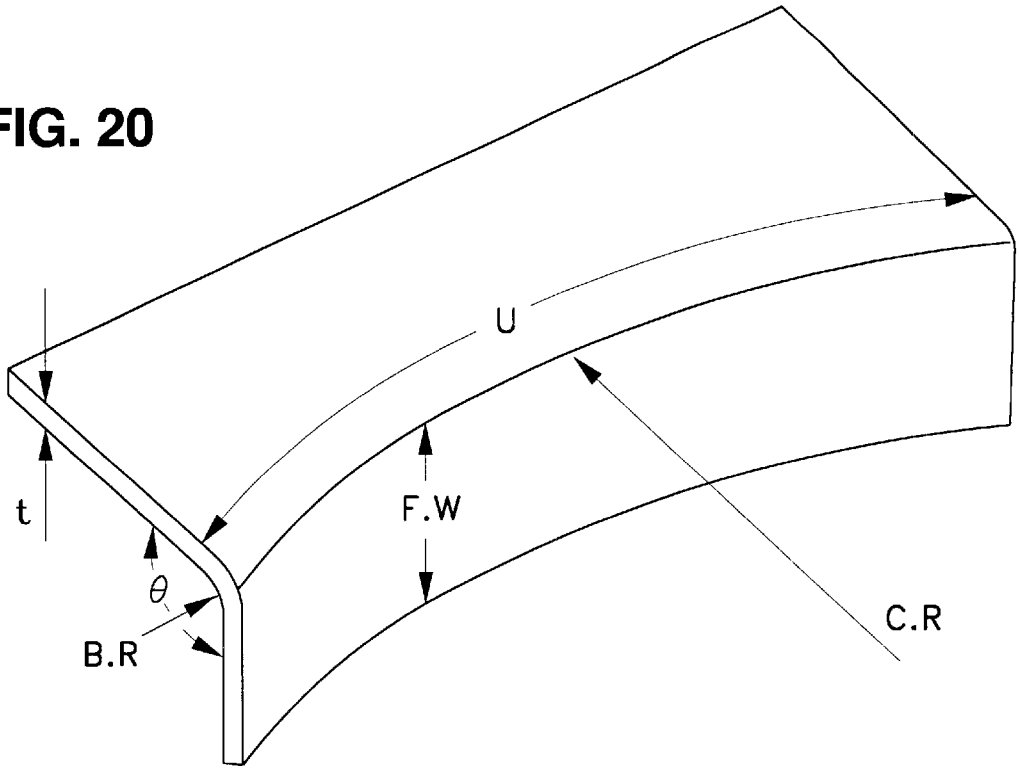
FIG. 20 is a perspective view depicting parameters of the stretch flange specimen.
Figure 21A:
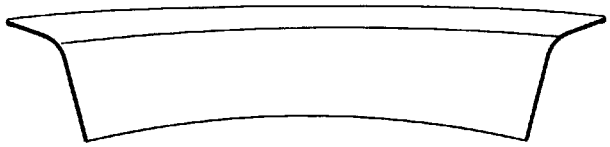
FIG. 21A–21D are perspective views of the stretch flange specimens each having a different arc length.
Figure 21B:
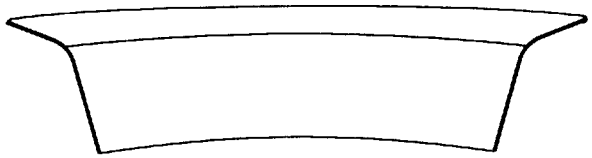
Figure 21C:
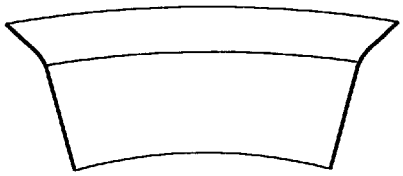
Figure 21D:
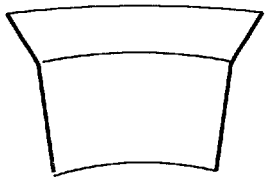
Figure 22:
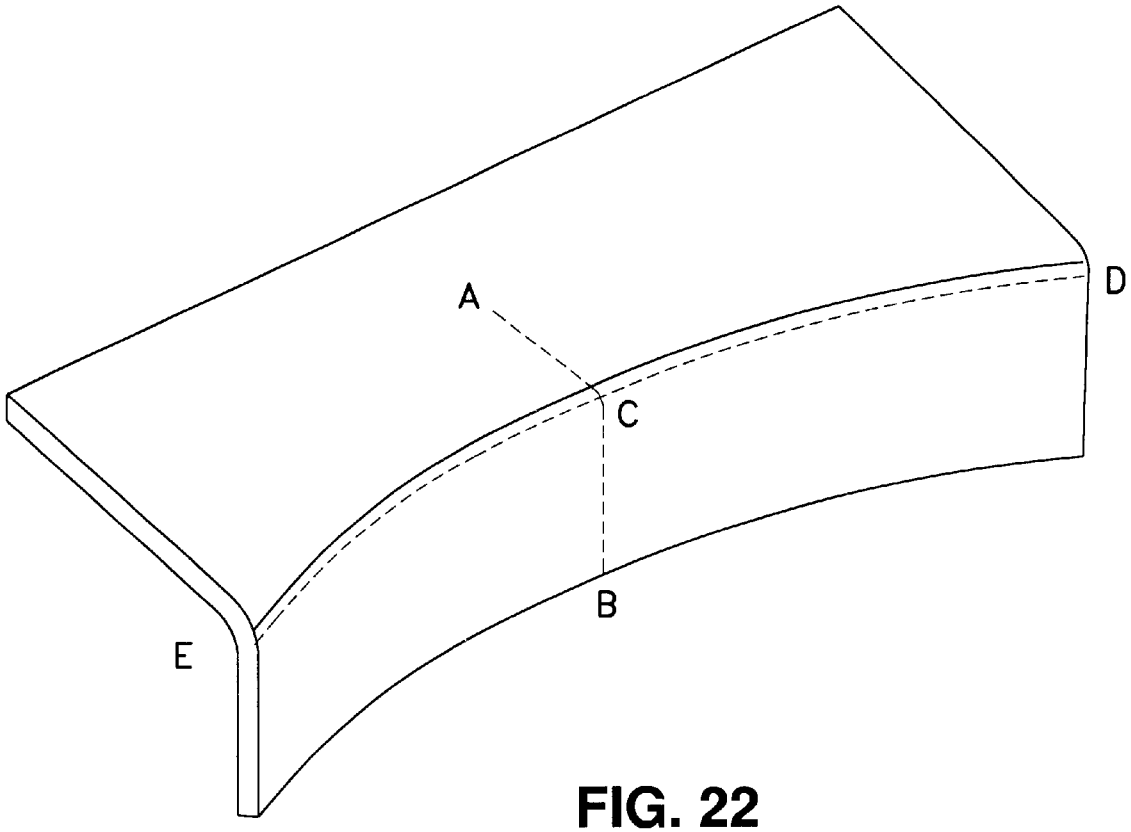
FIG. 22 is a perspective view depicting paths of strain measurements in the stretch flange specimen.
Figure 23:
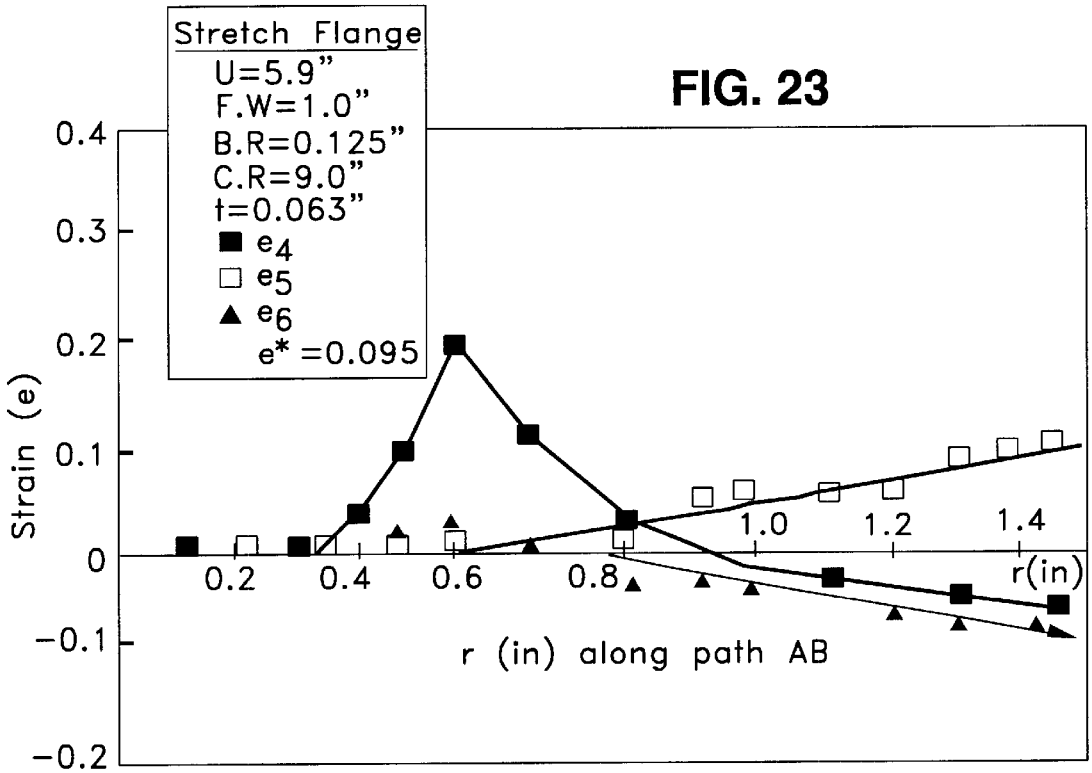
FIGS. 23–24 are graphs portraying strain distributions along a midsection of the stretch flange specimen (Path AB) as shown in FIG. 22.
Figure 24:
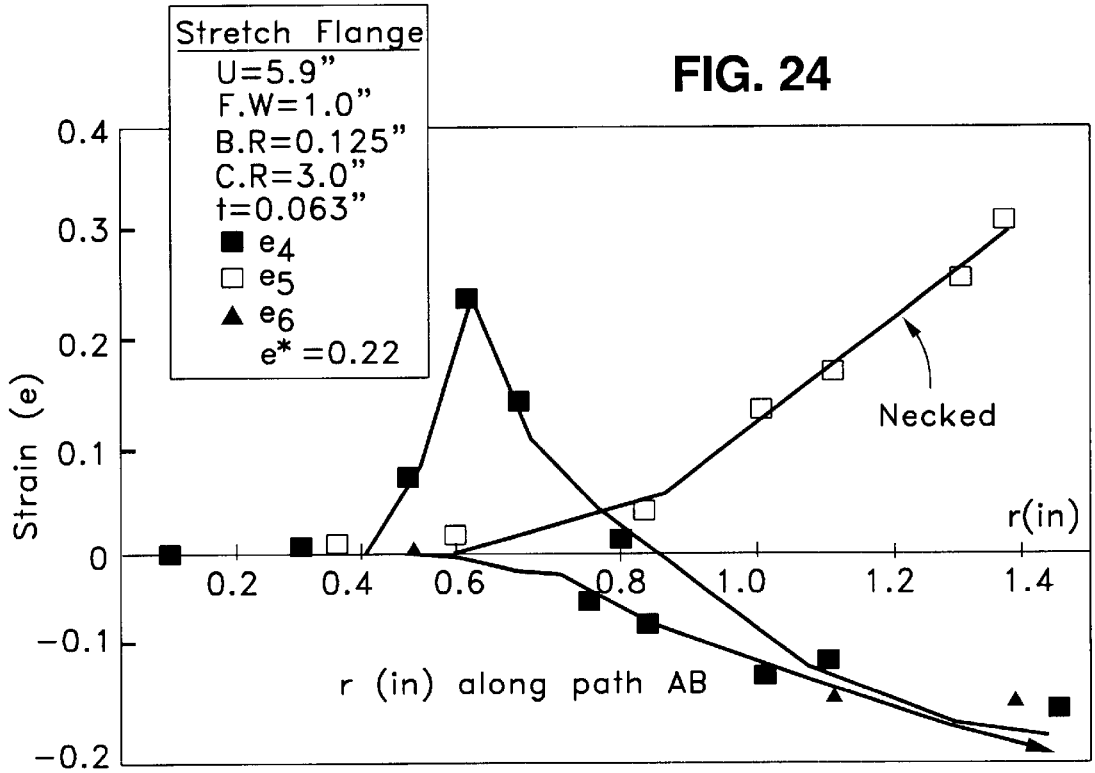
Figure 25:
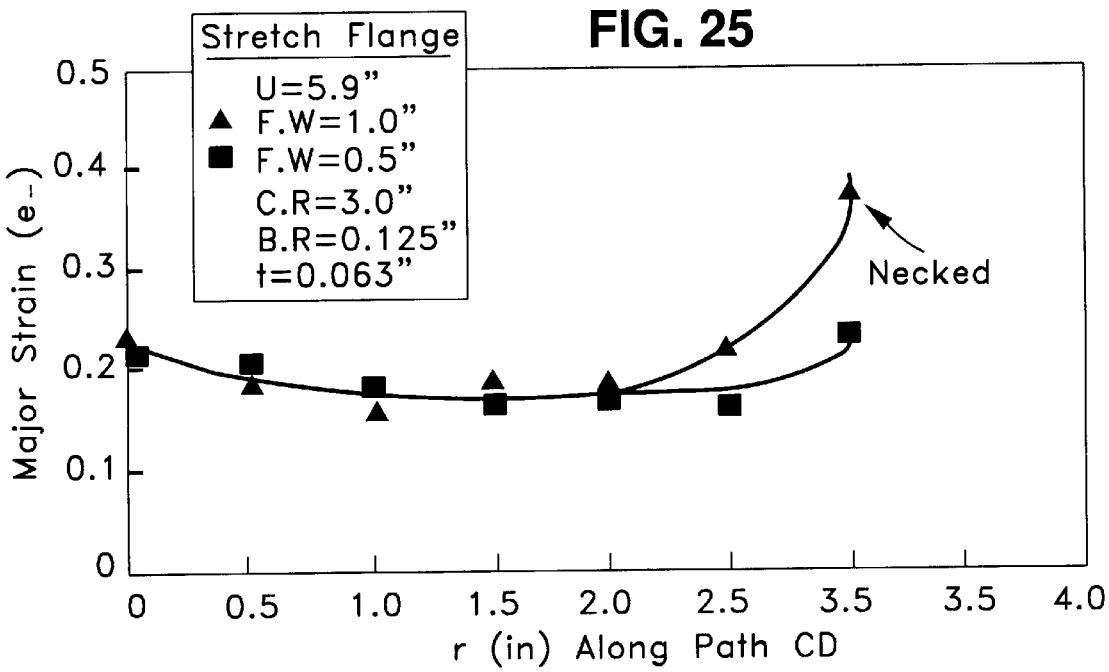
FIGS. 25–26 are graphs portraying strain distributions along a bend line of the stretch flange specimen (Path CD) as shown in FIG. 22.
Figure 26:
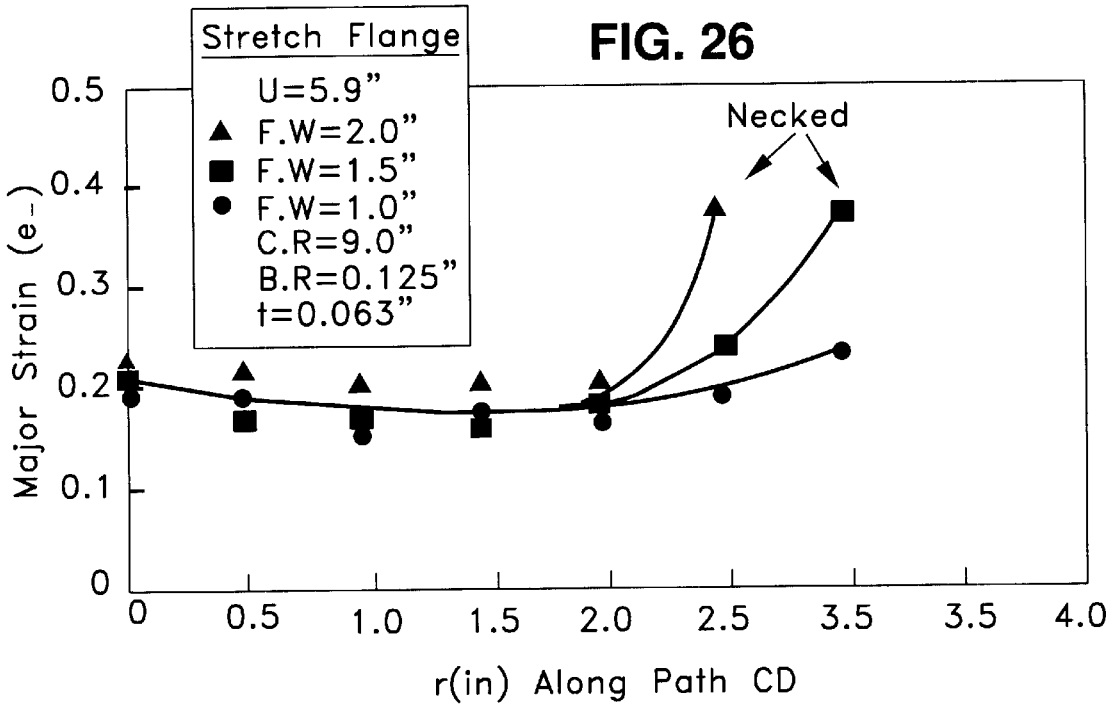

Referring to FIGS. 17 and 20, a stretch flange can be characterized as forming a concave bend 50 and flange 54 in a workpiece 52. The stretch flange can be defined by an arc length (u), a bend angle (⊖), a bend radius (BR), a contour radius (CR), and a flange width (FW). As shown in FIGS. 18, 19, and 22, two critical strain locations are expected for a stretch flange. The first is along the corner of the flange 54 as indicated by the dashed line E-C-D, with failure normally initiating at the ends 56 of the workpiece 52 and propagating towards the flange centerline B-C. The second is across the flange centerline B-C, with failure: typically starting at the bottom center of the flange 54 and propagating along line B-C. The major and minor strains should be calculated at each of these locations to evaluate the potential for workpiece failure. As a result, two families of strain correlations are developed to predict a corner strain ($e_{ecd}$) and centerline strain ($e_{bc}$). These correlations can be derived from the following relation:

$$e=K(u)^a(FW)^b(CR)^c(BR)^d(t)^e;$$

where e is the major or minor strain across the axis E-C-D and across the centerline B-c. As with the straight bend correlation, the constants a, b, c, d, e are determined by strain testing samples of the workpiece material; however, as explained below, one group of tests is performed to develop the exponent constants for the major and minor strains along the axis E-C-D, and another group of tests is performed to develop the exponent constants for the major,and minor strains across the axis B-C.

Figure 32:
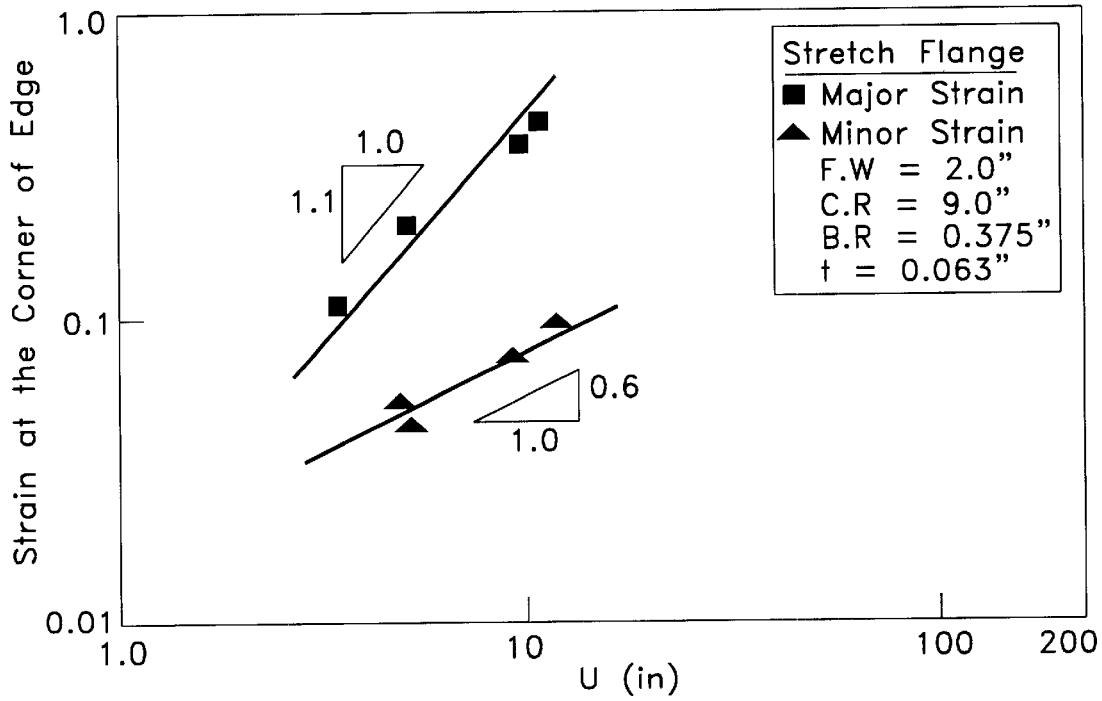
FIG. 32 illustrates a graph of the strain at the corner of the stretch flange specimen versus the arc length.

First, to establish a correlation for the corner strain $e_{ecd}$, a uniform strain can be assumed along the bottom edge of the flange. The major and minor strain constants for (a) are then obtained by arcuately bending a workpiece material samples having substantially equal thickness (t) into respective concave arcuate shapes having unequal arc lengths (u) and substantially equivalent flange widths (FW), contour radii (CR), and bend radii (BR). The major and minor strain is then measured along the bend corner as defined by the line E-C-B of FIG. 22. The major strain and minor strain are next plotted on a log-log scale as a function of arc length to develop logarithmic correlations of major strain and minor strain as a function of arc length (u) wherein the constant (a) corresponds to a slope characteristic of the correlations. An example of this process is shown in FIG. 32 where the major strain constant for (a) is 1.1/1=1, and the minor strain constant for (a) is 0.6/1.0=0.6.

Figure 33:
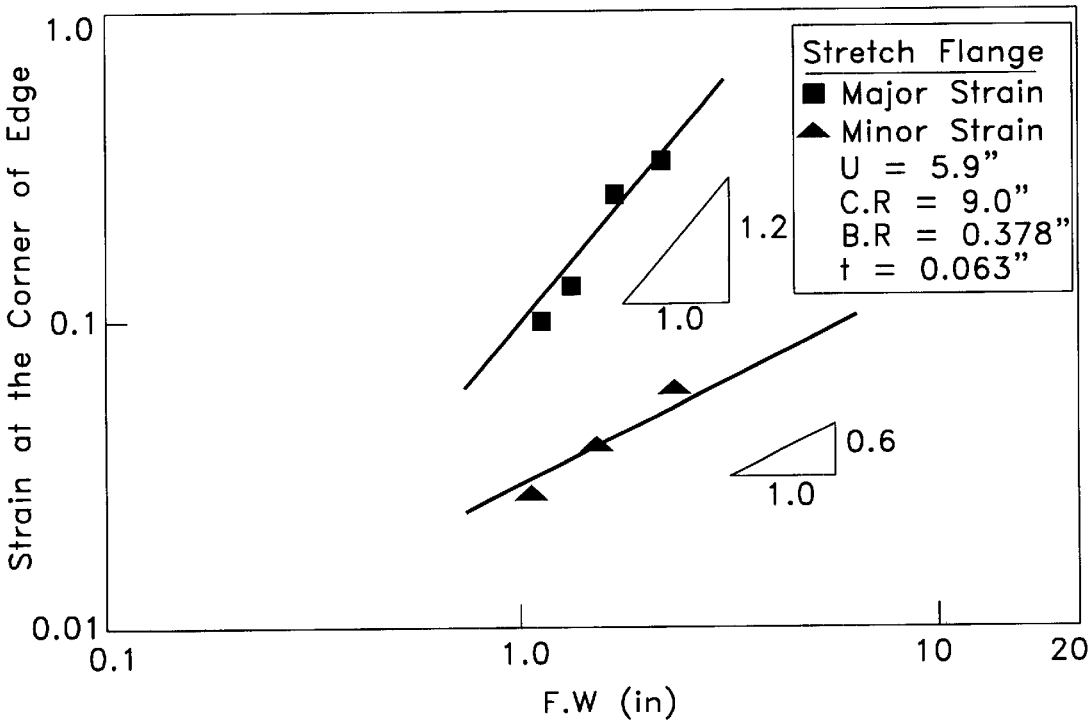
FIG. 33 illustrates a graph of the strain at the corner of the stretch flange specimen versus the stretch flange width.

Likewise, the major and minor strain constants for (b) are obtained by arcuately bending workpiece material samples having substantially equal thickness (t) into respective concave arcuate shapes having unequal flange widths (FW) and substantially equivalent arc lengths (u), contour radii (CR), and bend radii (BR). The major and minor strain values are then measured across the axis E-C-D to develop logarithmic correlations of major and minor strain as a function of flange width (FW) wherein the constant (b) corresponds to a slope characteristic of the correlations. An example of this process is shown in FIG. 33 in which the major strain constant for (b) is 1.2/1.0=1.2 and the minor strain constant for (b) is 0.6/1.0=0.6.

Figure 34:
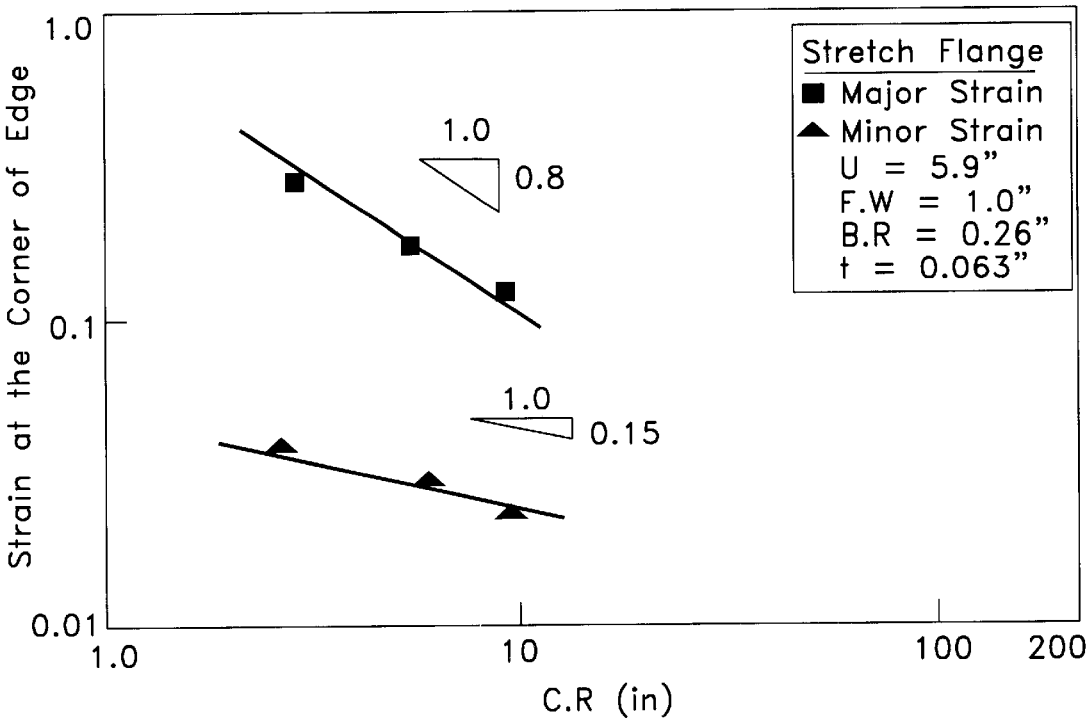
FIG. 34 illustrates a graph of the strain at the corner of the stretch flange specimen versus the stretch contour radius.

Similarly, the major and minor strain constants for (c) are obtained by arcuately bending workpiece samples having substantially equal thickness (t) into respective concave arcuate shapes having unequal contour radii (CR) and substantially equivalent flange widths (FW), arc lengths (u), and bend radii (BR). The major and minor strain values are then measured across the axis E-C-D to develop logarithmic correlations of major and minor corner strain as a function of contour radii (CR) wherein the constant (c) corresponds to a slope characteristic of the correlations. As an example, FIG. 34 shows a value of −0.8/1.0=−0.8 for the major strain constant and −0.15/1.0=−0.15 for the minor strain constant.

Figure 35:
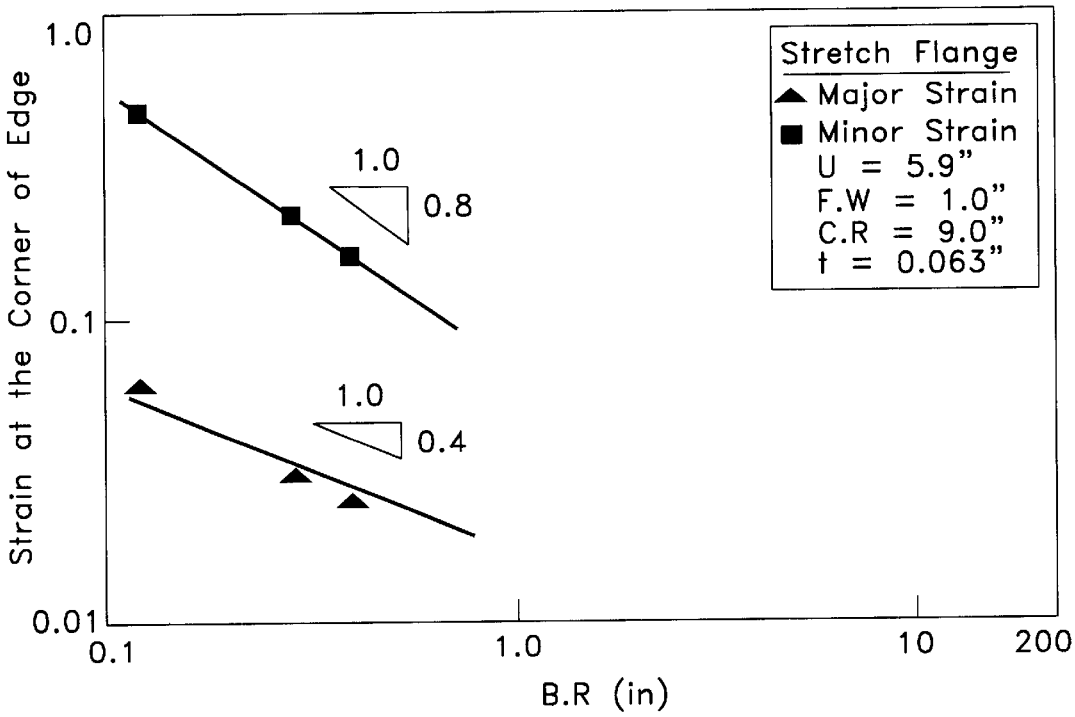
FIG. 35 illustrates a graph of the strain at the corner of the stretch flange specimen versus the stretch bend radius.

In the same manner, the major and minor strains constants (d) is obtained by arcuately bending workpiece samples having substantially equal thickness (t) into respective concave arcuate shapes having unequal bend radii (BR) and substantially equivalent arc lengths (u), contour radii (CR), and flange widths (FW). The major and minor strain values are then measured and used to develop logarithmic correlations of major and minor strain as a function of bend radius (BR) wherein the constant (d) corresponds to a slope characteristic of the correlations. An example is shown in FIG. 35 wherein the major strain constant for (d) is −0.8/1.0=−0.8 and the minor strain constant for (d) is −0.4/1.0=−0.4.

Figure 36:
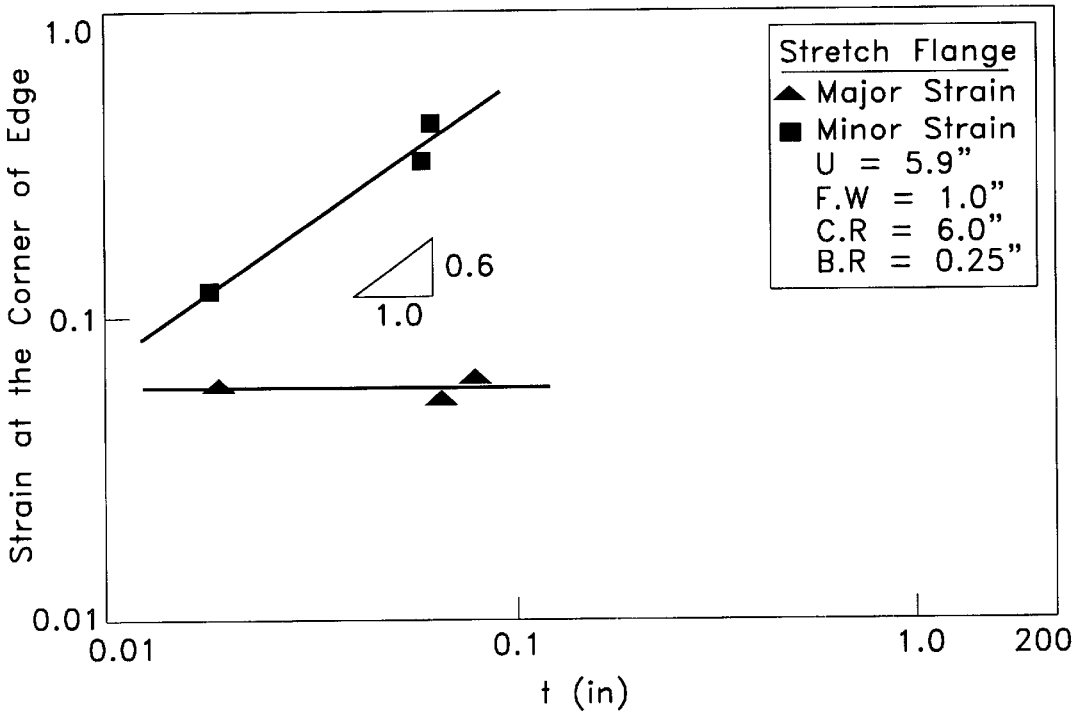
FIG. 36 illustrates a graph of the strain at the corner of the stretch flange specimen versus the stretch thickness.

Similarly, the major and minor strain constants for (e) are obtained by arcuately bending workpiece samples having unequal thickness (t) into respective concave arcuate shapes having substantially equivalent flange widths (FW), contour radii (CR), arc lengths (u), and bend radii (BR). The major and minor strain values are then measured across the axis E-C-D for developing logarithmic correlations of major and minor strain as a function of material thickness (t) wherein the constant (e) corresponds to a slope characteristic of the correlations. An example is shown in FIG. 36 wherein the major strain constant for (e) is 0.6/1.0=0.6, and the minor strain constant for (e) is 0.

The effect of flange width (FW) and bend angle (⊖) on major and minor strain can be simplified according to the following relation:

$$W=FW[1-\cos(\ominus)]; \quad \text{(IV)}$$

where W is an effective flange width. For bend angles greater than 90 degrees, the bend angle (⊖) can be assumed equal to 90 degrees. As such, the constant (K) may be determined experimentally. More specifically, the values of "a", "b", "c", "d" and "e" are calculated using FIGS. 32–36. Thereafter, an experiment may be performed and the strain at the onset of the failure may be determined. By substituting the value of "a", "b", "c", "d", "e", U, FW, CR, BR, t and strain (e), the value of K may be calculated via the equation:

$$e=K(U)^a(FW)^b(CR)^c(BR)^d(t)^e$$

Thus, with the values for a, b, c, d, e, and K determined, the correlations for the major strain ($e_{ecd,major}$) and minor strain ($e_{ecd,minor}$) across the axis E-C-D can be written as:

$$e_{c,major}=0.15(u)^a(FW)^b(CR)^c(BR)^d(t)^e \quad \text{(II)}$$

$$e_{c,minor}=-0.13(u)^a(FW)^b(CR)^c(BR)^d(t)^e \quad \text{(III)}$$

For the sample material shown in FIGS. 32–36, these relations reduce to:

$$e_{c,major}=0.15(u)^{1.1}(FW)^{1.2}(CR)^{-0.8}(BR)^d(t)^{0.6}$$

$$e_{c,minor}=-0.13(u)^{0.6}(FW)^{0.6}(CR)^{-0.15}(BR)^{-0.4}$$

Figure 27:
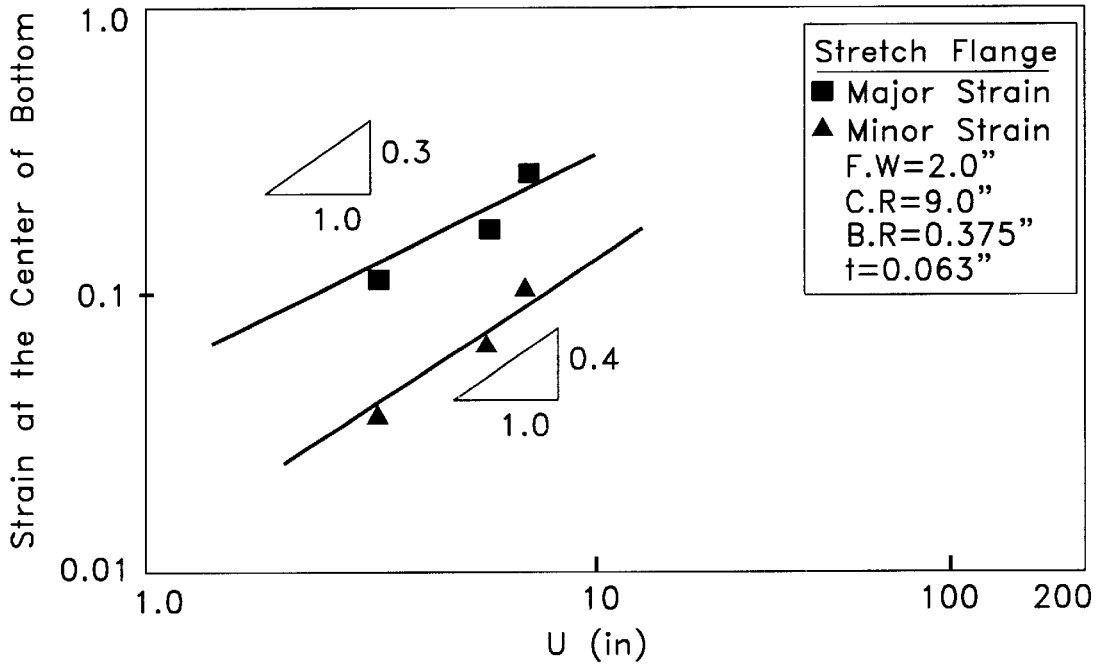
FIG. 27 illustrates a graph of the a strain at the bottom of the stretch flange specimen versus the arc length.

The major and minor strain correlations across the flange centerline B-C are developed in similar fashion. Specifically, the major and minor strain constants for (a) are obtained by arcuately bending workpiece samples having substantially equal thickness (t) into respective concave arcuate shapes having unequal arc lengths (u) and substantially equivalent flange widths (FW), contour radii (CR), and bend radii (BR). The major and minor strain is then measured across the flange centerline B-C and the values are used to develop logarithmic correlations of major strain and minor strain to arc length (u) wherein the constant (a) corresponds to a slope characteristic of the correlations. An example of this process is shown in FIG. 27 where the major strain constant for (a) is 0.3/1=0.3 and the minor strain constant for (a) is 0.4/1=0.4.

Figure 28:
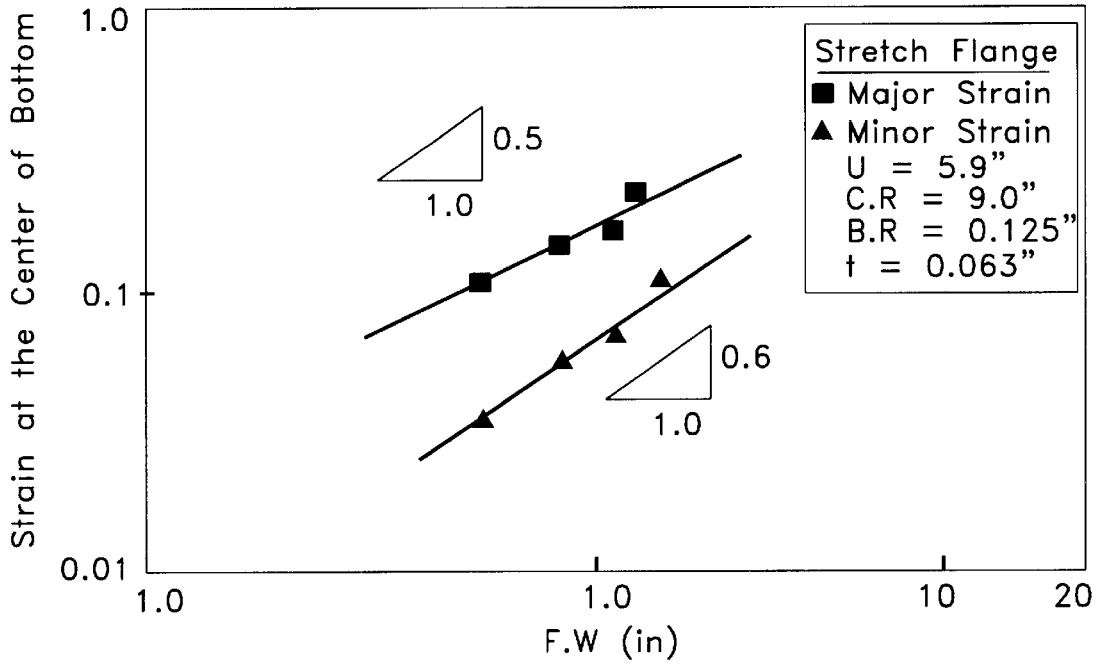
FIG. 28 illustrates a graph of the strain at the bottom of the stretch flange specimen versus a stretch flange width.

Likewise, the major and minor strain constants for (b) are obtained by arcuately bending workpiece material samples having substantially equal thickness (t) into respective concave arcuate shapes having unequal flange widths (FW) and substantially equivalent arc lengths (u), contour radii (CR); and bend radii (BR). The major and minor strain values are then measured across the flange centerline B-C for developing logarithmic correlations of major and minor strain as a function of flange width (FW) wherein the constant (b) corresponds to a slope characteristic of the correlations. An example of this process is shown in FIG. 28 in which the major strain constant for (b) is 0.5/1.0=0.5 and the minor strain constant for (b) is 0.6/1.0=0.6.

Figure 29:
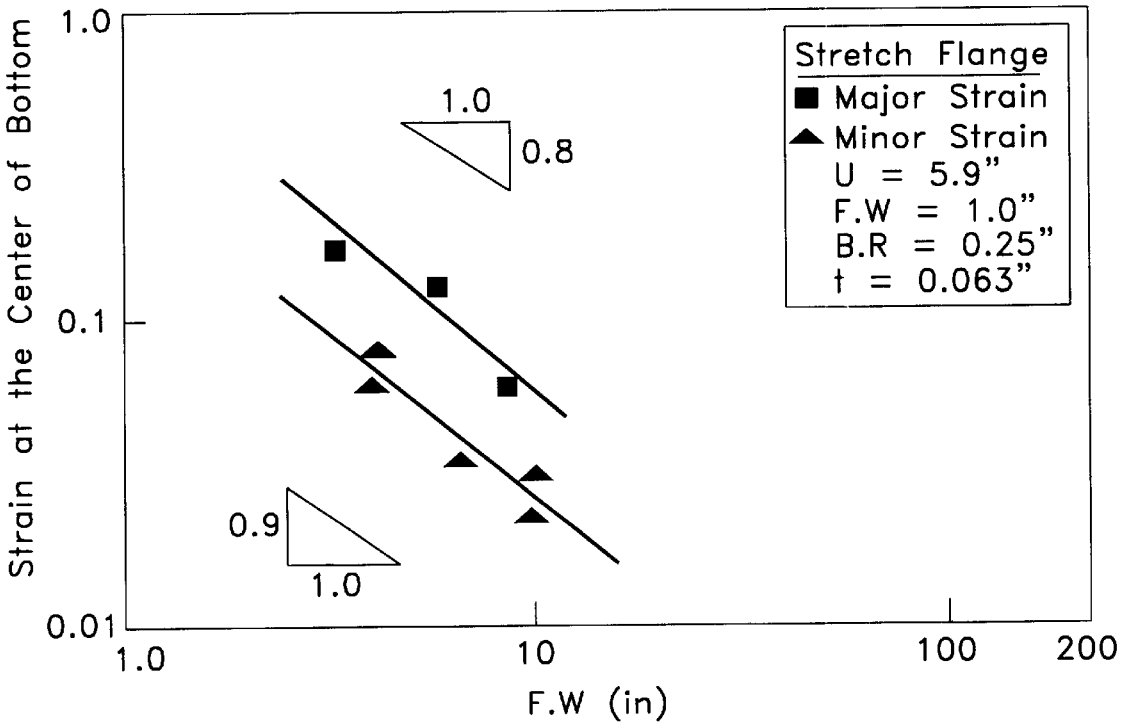
FIG. 29 illustrates a graph of the strain at the bottom of the stretch flange specimen versus a stretch contour radius.

Similarly, the major and minor strain constants for Ⓒ are obtained by arcuately bending workpiece samples having substantially equal thickness (t) into respective concave arcuate shapes having unequal contour radii (CR) and substantially equivalent flange widths (FW), arc lengths (u), and bend radii (BR). The major and minor strain values are then measured across the flange centerline B-C for developing logarithmic correlations of major and minor strain as a function of contour radius (CR) wherein the constant Ⓒ corresponds to a slope characteristic of the correlations. As an example. FIG. 29 shows a value of −0.8/1.0=−0.8 for the major strain constant and −0.9/1.0=−0.9 for the minor strain constant.

Figure 30:
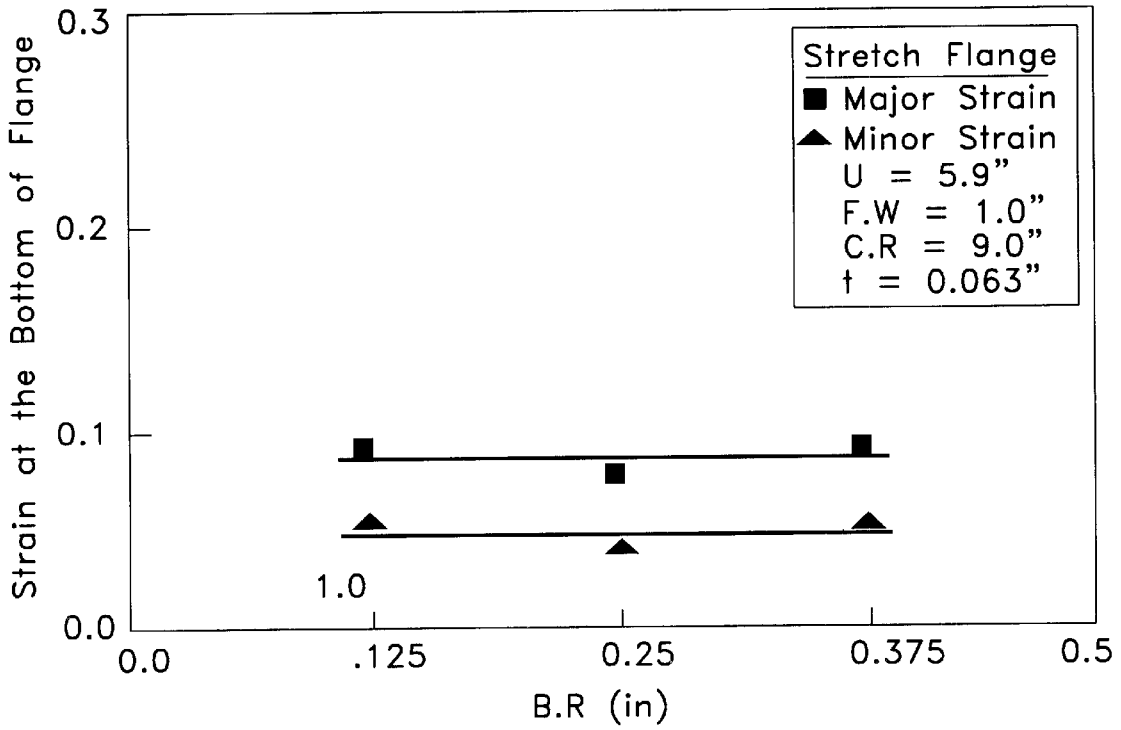
FIG. 30 illustrates a graph of the strain at the bottom of the stretch flange specimen versus a stretch bend radius.

In the same manner, the major and minor strains constants (d) is obtained by arcuately bending workpiece samples having substantially equal thickness (t) into respective concave arcuate shapes having unequal bend radii (BR) and substantially equivalent arc lengths (u), contour radii (CR), and flange widths (FW). Major and minor strain is then measured across the axis B-C for developing logarithmic correlations of major and minor strain as a function of bend radius (BR) wherein the constant (d) corresponds to a slope characteristic of the correlations. An example is shown in FIG. 30 wherein the major strain constant for (d) is 0 and the minor strain constant for (d) is 0. Thus, the major and minor strain are determined to be independent of bend radius (BR).

Figure 31:
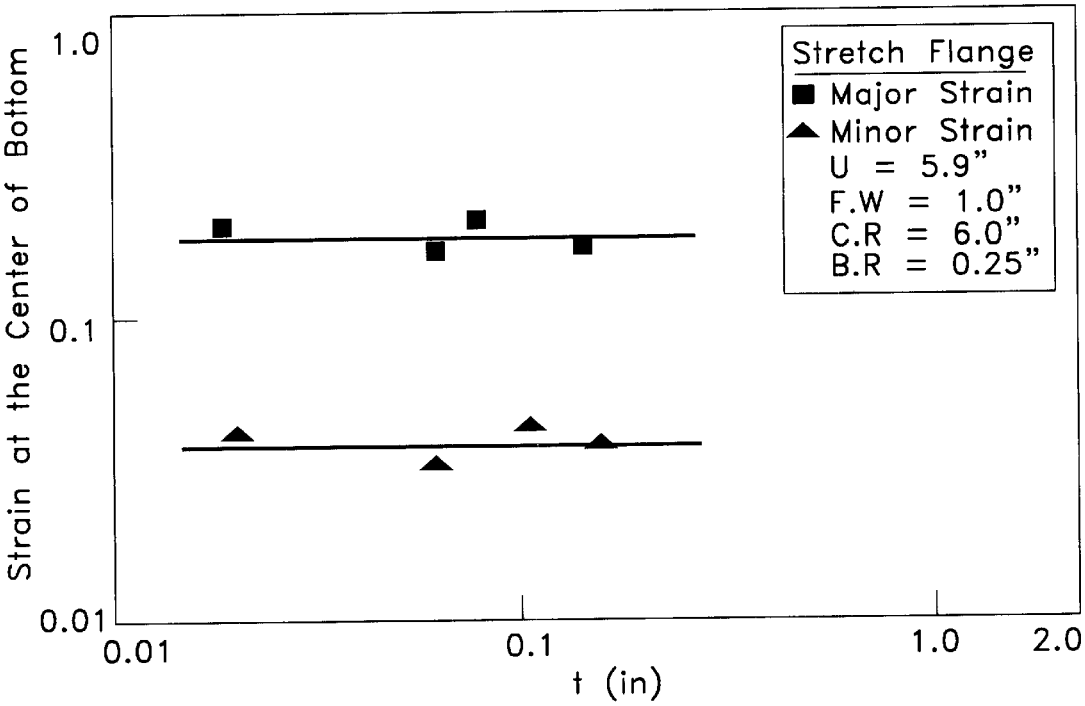
FIG. 31 illustrates a graph of the strain at the bottom of the stretch flange specimen versus a stretch thickness.

Similarly, the major and minor strain constants for (e) are obtained by arcuately bending workpiece samples having unequal thickness (t) into respective concave arcuate shapes having substantially equivalent flange widths (FW), contour radii (CR), arc lengths (u), and bend radii (BR). Major and minor strain is then measured across the axis B-C for developing logarithmic correlations of major and minor strain as a function of material thickness (t) wherein the constant (e) corresponds to a slope characteristic of the correlations. An example is shown in FIG. 31 wherein the major strain constant for (e) is 0 and the minor strain constant for (e) is 0. As such, the major and minor strain are determined to be independent of the workpiece thickness (t).

As above, the effect of flange width (FW) and bend angle (⊖) on major and minor strain can be restated according to the following relation:

$$W=FW[1-\cos(\ominus)]; \quad \text{(IV)}$$

where W is an effective flange width. For bend angles greater than 90 degrees, the bend angle (⊖) can be assumed equal to 90 degrees. As such, the constant (K) may be determined experimentally via the similar procedure disclosed above. Thus, with the constants a, b, c, d, e, and K determined, the major and minor strain correlations for the midspan of the flange can be rewritten in the form:

$$e_{m,major}=0.39(u)^a(FW)^b(CR)^c \quad \text{(V)}$$

$$e_{m,minor}=-0.16(u)^a(FW)^b(CR)^c(BR)^d(t)^e \quad \text{(VI)}$$

As an example, the strain correlations for the sample material of FIGS. 27–31 can be written as:

$$e_{b,major}=0.39(u)^{0.3}(FW)^{0.5}(CR)^{-0.8}$$

$$e_{b,minor}=-0.16(u)^{0.4}(FW)^{0.6}(CR)^{-0.9}$$

Thus, once the constants (a), (b), (c), (d), (e), (f), and (K) are determined, the major and minor corner strains ($e_{ecd,major}$), ($e_{ecd,minor}$) and major and minor centerline strains ($e_{bc,major}$), ($e_{bc,minor}$) are calculated by inputting the proposed bend angle (⊖), bend radius (BR), contour radius (CR), flange width (FW), thickness (t) and arc length (u) into equations II–VI. When the method 10 is incorporated within a software program, the input parameters for the strain correlations can be input manually, such as with a keyboard, or downloaded from a standard CAD program. The calculated strains ($e_{ecd,major}$), ($e_{ecd,minor}$), ($e_{bc,major}$), ($e_{bc,minor}$) are then compared with the material yield strain ($e_y$) from the FLD diagram to determine suitability of the workpiece material. If the calculated strains are less than the yield strain ($e_y$), the workpiece 52 can be classified as suitable or potentially suitable if other bend types or spring back will be analyzed. On the other hand, when the calculated strains are greater or equal to the yield strain ($e_y$), the workpiece can be classified as unsuitable and an alternative workpiece can be selected. As with the straight bend correlations, the same strain correlations for ($e_{ecd,major}$), ($e_{ecd,minor}$), ($e_{bc,major}$), ($e_{bc,minor}$) can be re-utilized for the alternative workpiece so long as the workpiece material is the same. Thus, testing does not have to be repeated if the same material is selected. In addition, if the shape of the finished product is modified in the future, the same strain correlations can be used to evaluate workpiece suitability as long as the same material is utilized.

Shrink Flange Strain

Figure 37:
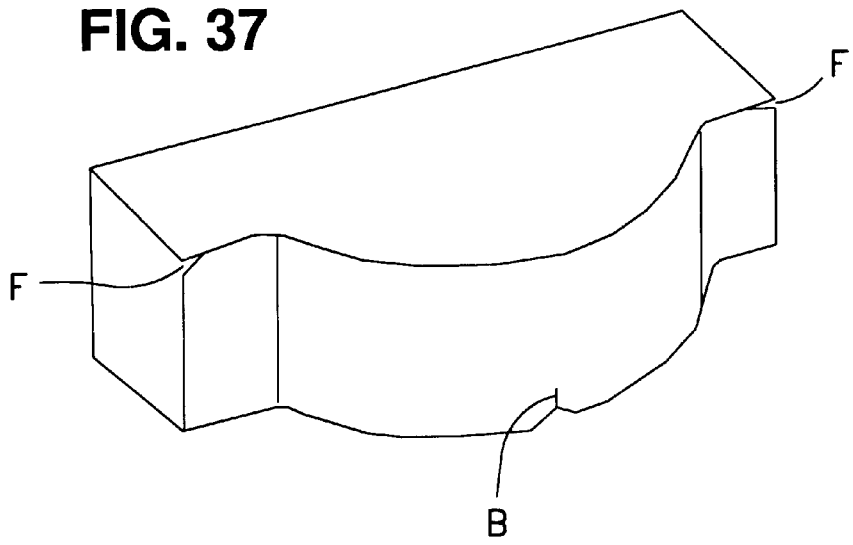
FIG. 37 is a perspective view of a shrink forming die and a shrink flange specimen.
Figure 38:
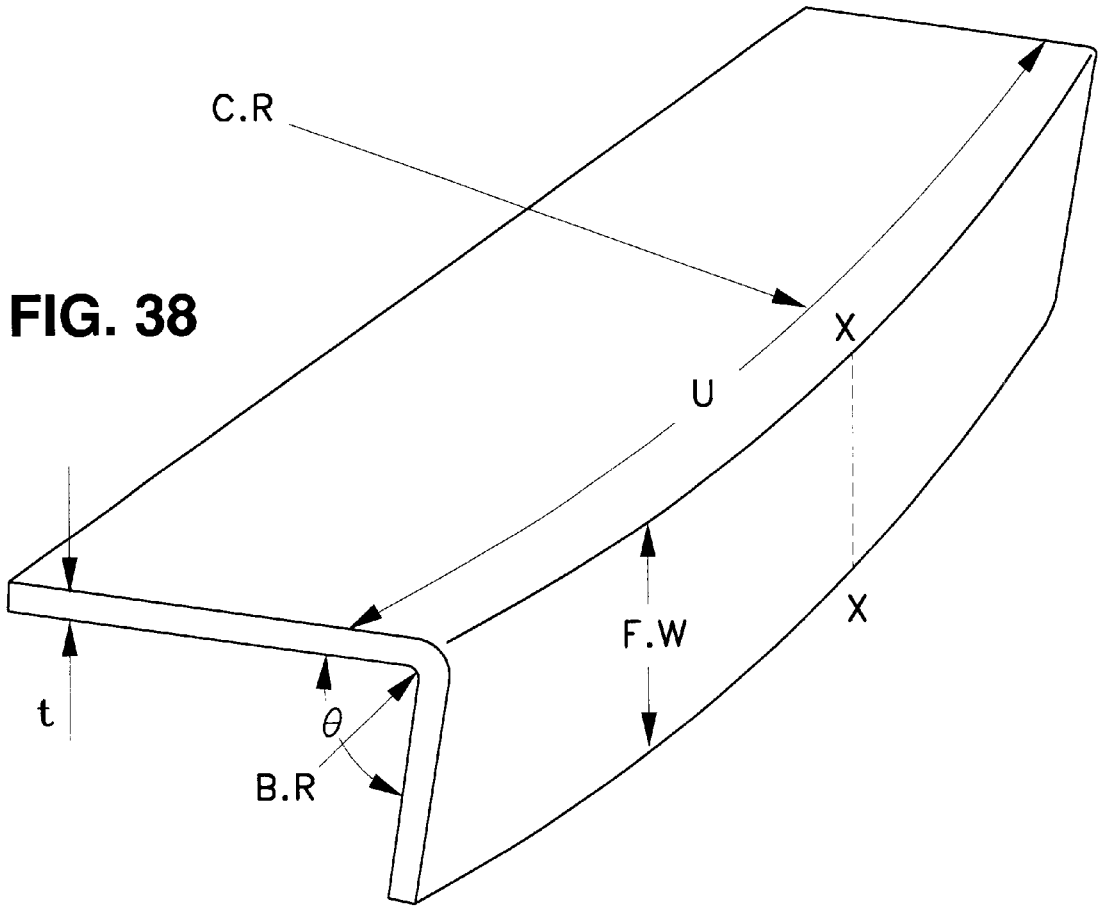
FIG. 38 is a perspective view depicting parameters of the shrink flange specimen.

Referring to FIGS. 37 and 38, a shrink flange can be characterized as forming a convex bend 60 and flange 66 in a workpiece 62. Two types of workpiece failure are typical for a shrink flange. First, the workpiece 62 can develop a fracture (F) along the bend line 64 when the bend radius (BR) is smaller than the critical bend radius for a straight bend. Second, the workpiece can develop a longitudinal buckle (B) across the workpiece flange 66.

The straight bend strain correlation (I) can be used to calculate an expected bend strain ($e_{bs}$) for comparison with the material yield strain ($e_y$). As described above with respect to straight bends, the workpiece 62 can be classified as unsuitable, and an alternative workpiece can be selected, if the expected straight bend strain ($e_{sb}$) is greater or equal to the material yield strain ($e_y$). However, if the expected straight bend strain ($e_{sb}$) is less than the material yield strain ($e_y$), then the workpiece 62 can also be checked for a buckling type failure.

Buckling is a function of the pressure (P) applied by the forming press, the workpiece stiffness, and the final as-formed shape of the workpiece. Buckling typically initiates at the bottom, center of the workpiece flange 66, and generally occurs before the workpiece 62 fractures. As such, the tendency to buckle can be determined by comparing the expected strain at the bottom, center of the flange ($e_{bc}$) with the buckle strain ($e_b$) for the material, that is, the maximum compressive strain of the workpiece material before it buckles.

The expected bottom center strain ($e_{bc}$) can be expressed as a function of the flange width (FW), contour radius (CR), arc length (u), bend angle (⊖), material thickness (t), and press pressure (P) according to the following relations:

$$e_{bc}=K(u)^a(FW)^b(CR)^c(t)^d(P)^f; \quad \text{(VII)}$$

$$W(\text{effective flange width})=FW[1-\cos(\ominus)]; \quad \text{(VIII)}$$

where W is an effective flange width and (⊖) can be assumed equal to 90 degrees when the bend angle is greater than 90 degrees. The (K) is a shrink flange constant for the material, (a) is an arc length constant, (b) is a flange width and bend angle constant, (c) is a contour radius constant, (d) is a thickness constant, and (f) is a pressure constant.

The tendency for the workpiece 62 to buckle can be determined by comparing the buckle strain ($e_b$) to the expected bottom center strain ($e_{bc}$). Specifically, successful formation of a shrink flange can be indicated when the following inequality is satisfied:

$$e_b > K(u)^a(FW)^b(CR)^c(t)^d(P)^f$$

The inequality can also be rewritten in the forms:

$$(e_b)^{1-b} > K^{-b}(u)^{a-b}(FW)(CR)^{c-b}(t)^{d-b}(P)^{f-b}$$

or $$k > W/[(u)^m(CR)^n(t)^s(P)^v] \quad \text{(IX)}$$

where $k=K^b(e)^{1-b}$; m=b−a; n=b−c; s=b−d; v=b−f

Figure 39:
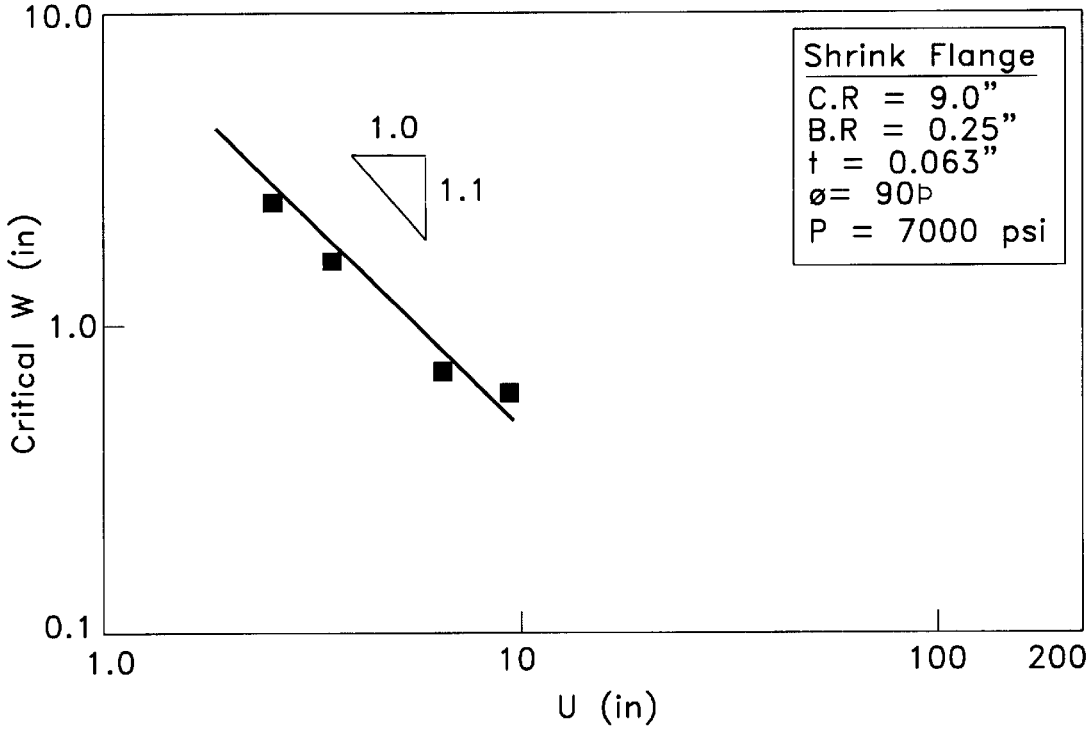
FIG. 39 illustrates a graph of a shrink flange width versus a shrink arc length.

The constants (a), (b), (c), (d), and (f) may be obtained experimentally by utilizing the similar process as described above. Moreover, the constants (m), (n), (s), and (v) can also be obtained experimentally, as will be described below. For example, the constant (m) can be determined by shrink forming workpiece samples while holding the press pressure (P), arc length (u), contour radius (CR), bend angle (⊖) and thickness (t) constant, and increasing the flange width (FW) of the samples until buckling is observed. The maximum, or critical effective flange width (W) is then plotted on a log-log scale versus arc length. This process is repeated for samples having different respective arc lengths (u), and the constant (m) corresponds to the slope of the resulting logarithmic curve. An example is shown by example in FIG. 39, wherein the constant (m) is −1.1/1.0=−1.1.

Figure 40:
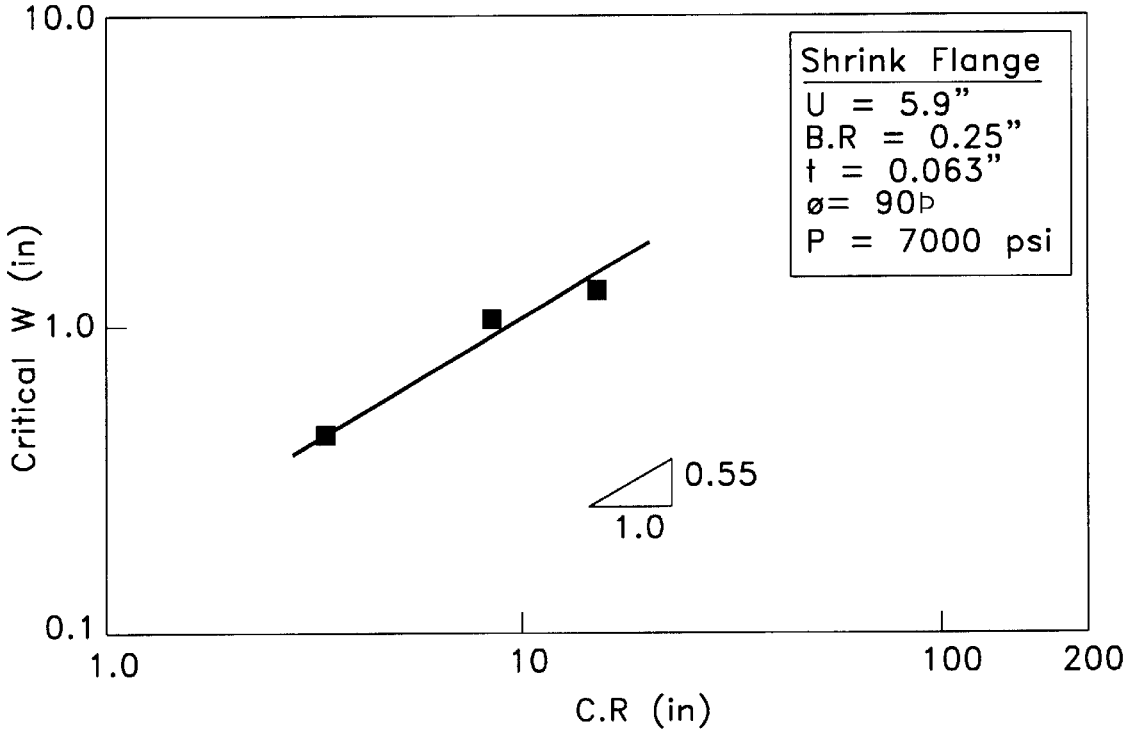
FIG. 40 illustrates a graph of the shrink flange width versus a shrink contour radius.

Likewise, the constant (n) can be determined by shrink forming workpiece samples while holding the press pressure (P), arc length (u), contour radius (CR), bend angle (⊖) and thickness (t) constant, and increasing the flange width (FW) until buckling is observed. This procedure is the same as described for the constant (m), and does not have to be repeated. The maximum effective flange width (W) is then plotted on a log-log scale versus arc length. This process is repeated for samples having different respective contour radius (CR), and the constant (n) corresponds to the slope of the resulting logarithmic curve. An example is shown by example in FIG. 40, wherein the constant (n) is 0.55/1.0=0.55.

Figure 41:
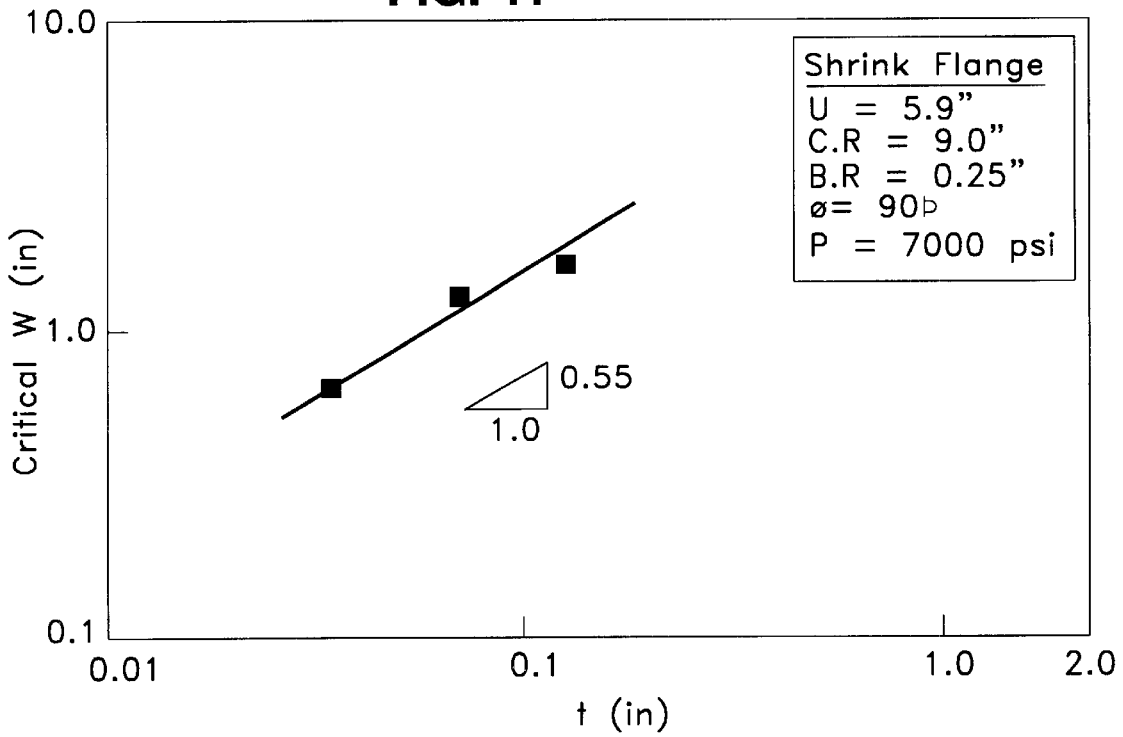
FIG. 41 illustrates a graph of the shrink flange width versus a shrink thickness.

Similarly, the constant (s) can be determined by shrink forming workpiece samples while holding the press pressure (P), arc length (u), contour radius (CR), bend angle (⊖) and thickness (t) constant, and increasing the flange width (FW) until buckling is observed. This procedure is the same as described for (m) and (n), and does not have to be repeated. The maximum effective flange width (W) is then plotted on a log-log scale versus arc length. The process is repeated for samples having different respective thicknesses (t), and the constant (s) corresponds to the slope of the resulting logarithmic curve. An example is shown in FIG. 41, wherein the constant (s) is also 55/1.0=0.55.

Figure 42:
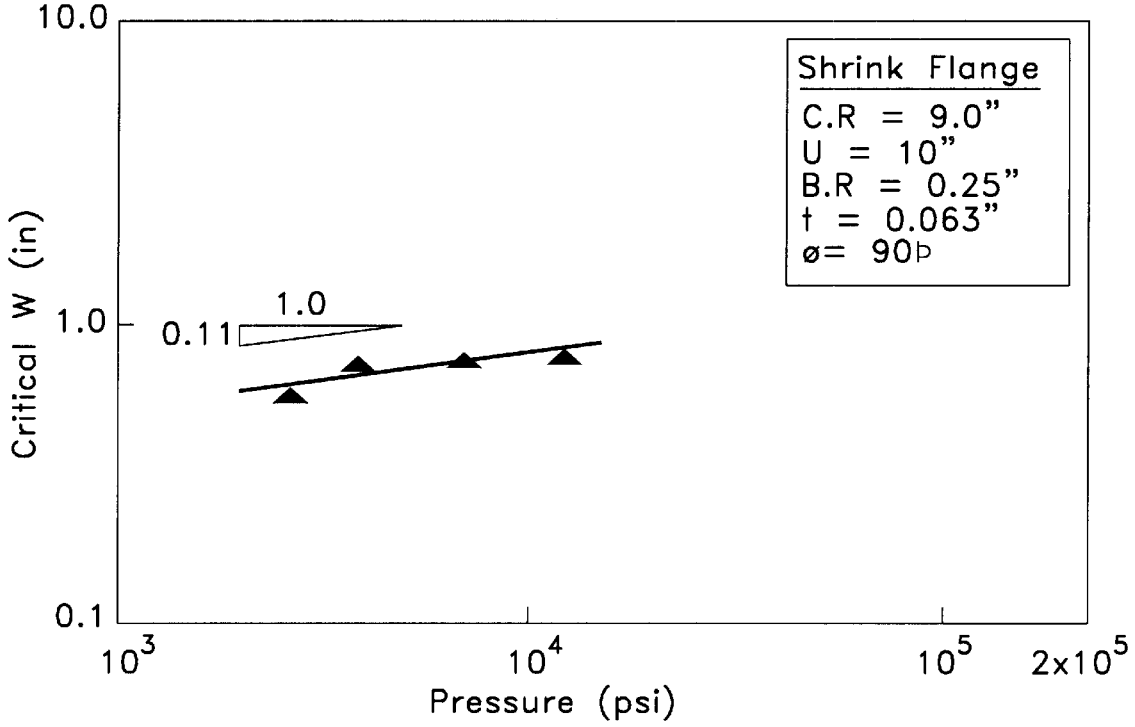
FIG. 42 illustrates a graph of the shrink flange width versus a press pressure.

In the same fashion, the constant (v) can be determined by shrink forming workpiece samples while holding the press pressure (P), arc length (u), contour radius (CR), bend angle (⊖) and thickness (t) constant, and increasing the flange width (FW) until buckling is observed. This procedure is the same as described for (m), (n), and (s) and does not have to be repeated. The maximum effective flange width (W) is then plotted on a log-log scale versus arc length. The process is repeated for with different press pressures (P), and the constant (v) corresponds to the slope of the resulting logarithmic curve. An example is shown in FIG. 42, wherein the constant (v) is 0.11/1.0=0.11. Thus, for the material described in FIGS. 39–42, equation (V) reduces to:

$$k > W(u)^{1.1}(CR)^{-55}(t)^{-0.55}(P)^{-11}$$

In addition, the constant (k) may be determined experimentally. More specifically, after obtaining the values of "m", "n", "s" and "v" and substituting such values along with other obtained values, the values of (k) may be calculated via the equation above. However, it should be noted that the value of (k) may vary slightly for each workpiece 52. In such cases, the plot of the best fit line, or the average value, may be utilized for the value of (k). The values of k for some materials are shown in Table 2:

TABLE 2

| Material/Temper | k |
|---|---|
| 2024-0 | 3.9 |
| 2024-T4 | 2.1 |
| 2024-T3 | 1.8 |
| 2024-AQ | 2.4 |
| 304 annealed | 2.0 |

Referring now to FIGS. 4 and 4A, once the constants m, n, s, and v are determined, the expected bottom center shrink form strain ($e_{bc}$) can be calculated by inputting a flange width (FW), bend angle (⊖), arc length (u), contour radius (CR), and thickness (t) into equations (VIII) and (IX). The resulting strain value ($e_{bc}$) can be then be compared with the constant (k) to evaluate the formability of the workpiece 62. Specifically, if the strain ($e_{bc}$) is greater than or equal to the constant (k), then an alternative workpiece can be selected and evaluated according to the same process. The material testing does not have to be repeated however, nor do the constants (m), (n), (s), (v), and (k) have to be re-calculated, if the same workpiece material is selected as an alternative. If instead, the strain ($e_{bc}$) is less than the constant (k), and the bend strain ($e_{bs}$) is less than the material yield strain ($e_y$) than the workpiece can be tentatively classified as suitable pending the analysis of other bends in the workpiece.

Spring Back Deformation

The method of the present invention can also include a procedure for calculating the spring back deformation of the as-formed part. Spring back deformation is the counter reaction of the workpiece and its tendency to expand, or spring back, into an intermediate shape after press forming. In some cases, spring back deformation can cause the workpiece to deviate significantly from the intended shape and dimensions of the finished product. Thus, to compensate for this effect, the extent of spring back deformation can be calculated so that adjustments can be made in the press forming process to achieve the desired product shape.

The spring back analysis of the present invention encompasses two types of spring back deformation. The first type of spring back reaction ($s_s$) is caused by straight bends and can be expressed as a function of the material thickness (t), the bend radius (BR), bend angle (⊖), and press forming pressure (P). The second type of spring back reaction ($s_{cf}$) is caused by curved flanges and can be expressed as a function of the material thickness (t), the bend radius (BR), bend angle (⊖), contour radius (CR), and press forming pressure (P). These functions can be written in the general form:

$$s_s = k_1(t)^a(BR)^b(\ominus)^c(P)^d \quad \text{(X)}$$

$$s_{cb} = k_2(t)^m(BR)^n(\ominus)^r(CR)^s(P)^v \quad \text{(XI)}$$

where (a) and (m) are thickness constants, (b) and (n) are bend radius constants, (c) and (r) are bend angle constants, (s) is a contour radius constant, (d) and (v) are press forming pressure constants, and ($k_1$) and ($k_2$) are material constants.

More specifically, the values of the (a), (b), (c), (d), (m), (n), (r), (s) and (v) may be determined from tests by setting one parameter as variable and the rest as constants. For instance, in order to determine (a), the BR, ⊖ and P may be set as constants and use different t for the test.

For equations (X) and (XI), the effect of thickness (t) and bend radius (BR) can be expressed as a single independent variable having a single exponent constant according to the following relations:

$$s_s=k_1[(BR)/(t)]^{b/a}(\ominus)^c(P)^d \quad \text{(XII)}$$

$$s_{cb}=k_2[(BR)/(t)]^{n/m}(\ominus)^r(CR)^s(P)^v \quad \text{(XIII)}$$

Figure 44:
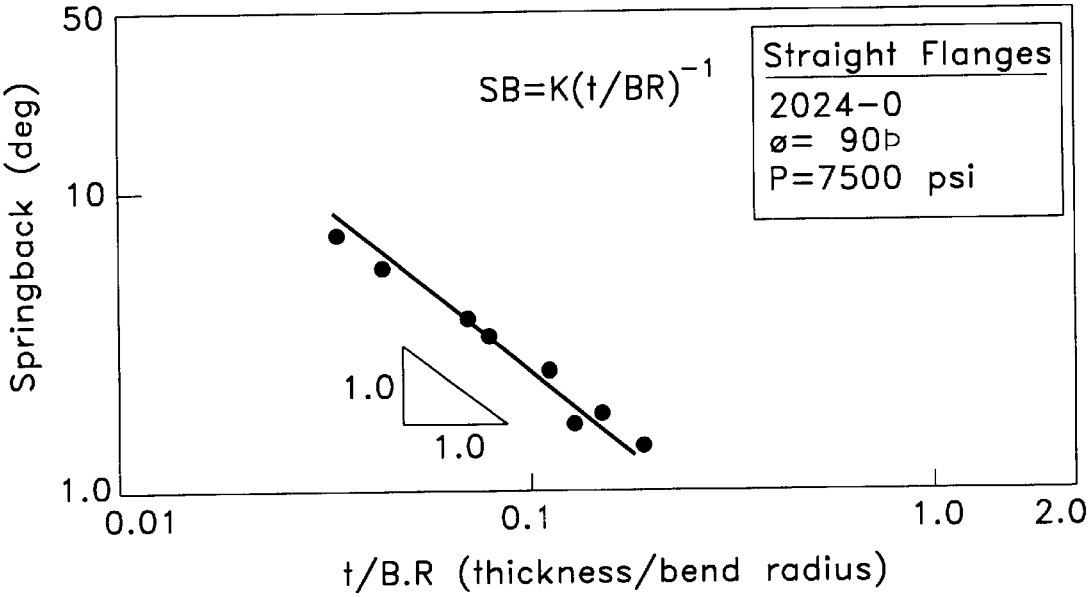
FIG. 44 illustrates a log-log plot of the springback of the straight bend versus the thickness/bend radius (t/B.R.) for 2024-O aluminums.

The constants (b/a) and (n/m) can be determined by forming a straight or curved bend in respective workpiece samples with the same press forming pressure (P) and having the same bend angle (⊖) but varying ratios of bend radius to thickness (t)/(BR). The angle of spring back is then measured and plotted on log-log scale versus the ratio (t)/(BR) wherein the constant (b/a) and (n/m) correspond to the slope of the curve. An example is shown in FIG. 44 in which (b/a) and (n/m) are −1.0/1.0=−1.0.

Figure 45:
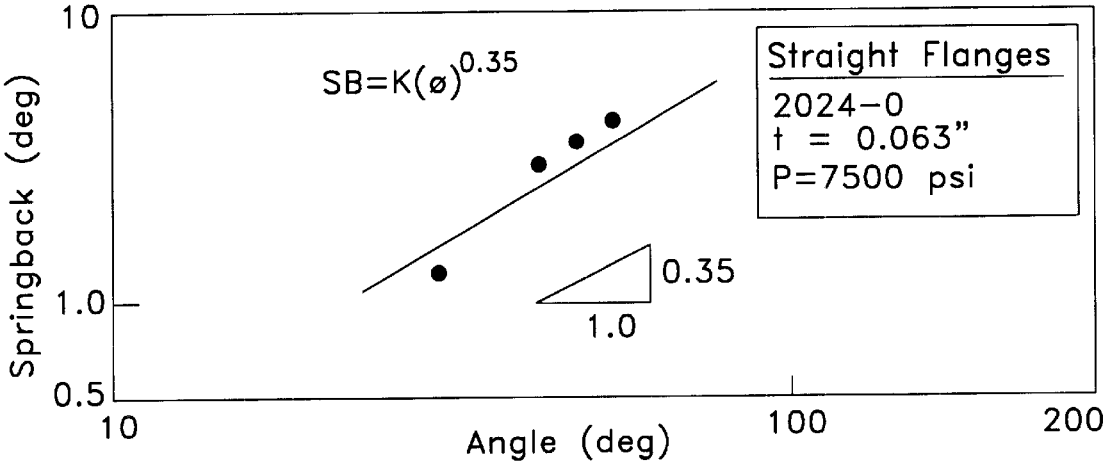
FIG. 45 is a graph portraying the effect of the bend angle on the springback for 2024-O aluminums.

Likewise, the constants Ⓒ and (r) can be determined by forming a straight or curved bend in respective workpiece samples with the same press forming pressure (P) and having the same thickness (t) and bend radii (BR) but different bend angles (⊖). The angle of spring back is then measured and plotted on log-log scale versus (⊖) wherein the constants Ⓒ and (r) correspond to the slope of the curve. An example is shown in FIG. 45 in which the constants Ⓒ and (r) are 0.35/1.0=0.35.

Figure 46:
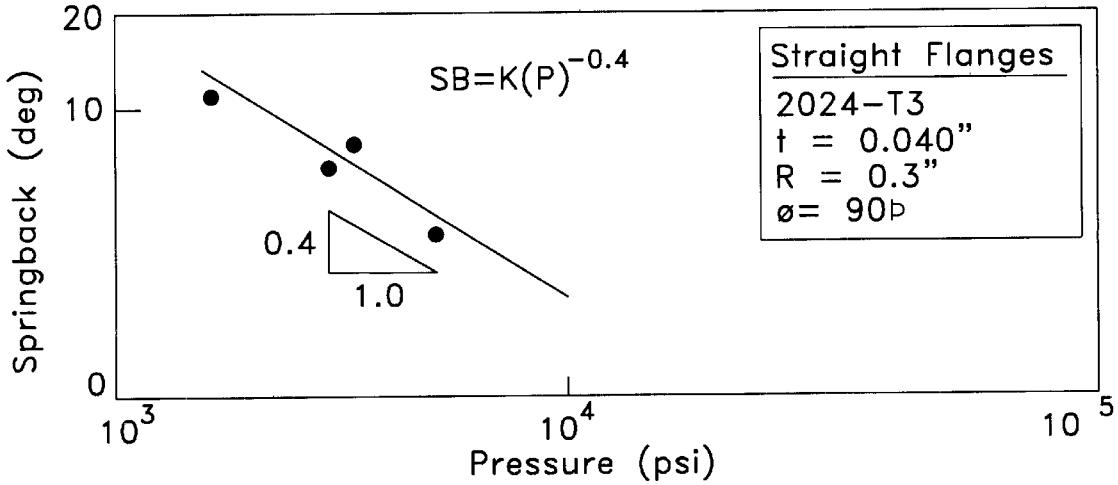
FIG. 46 is a graph portraying the effect of the pressure on the springback for 2024-T3 aluminums.

Similarly, the constants (d) and (v) are determined by forming straight or curved bends in workpiece samples with different press forming pressures (P) and having the same thickness (t), bend angle (⊖), and bend radii (BR). The angle of spring back is then measured and plotted on a log-log scale as a function of press forming pressure (P). An example is shown in FIG. 46 in which the constants (d) and (v) are −0.4/1.0=−0.4.

Figure 47:
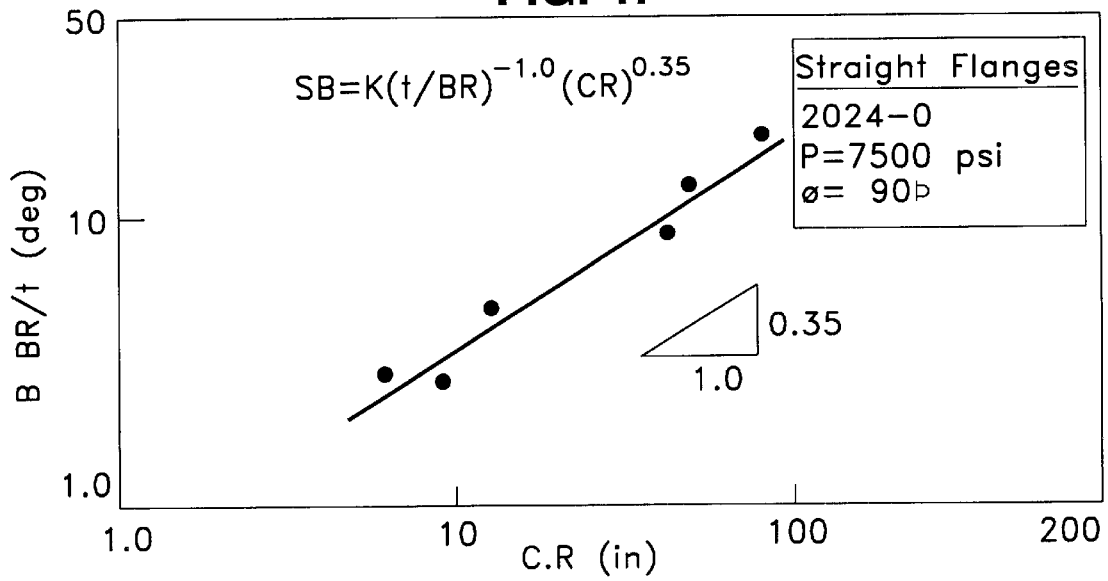
FIG. 47 is a graph portraying the springback of a curved form for 2024-O aluminum.

In like fashion, the constant (s) can be determined by forming a bend in respective workpiece samples with the same press forming pressure (P) and having the same thickness (t), bend radii (BR), and bend angles (⊖), but different contour radii (CR). The angle of spring back is then measured and plotted on log-log scale versus (CR) wherein the constant (s) corresponds to the slope of the curve. An example is shown in FIG. 47 in which the constant (s) is 0.35/1.0=0.35.

Figure 43:
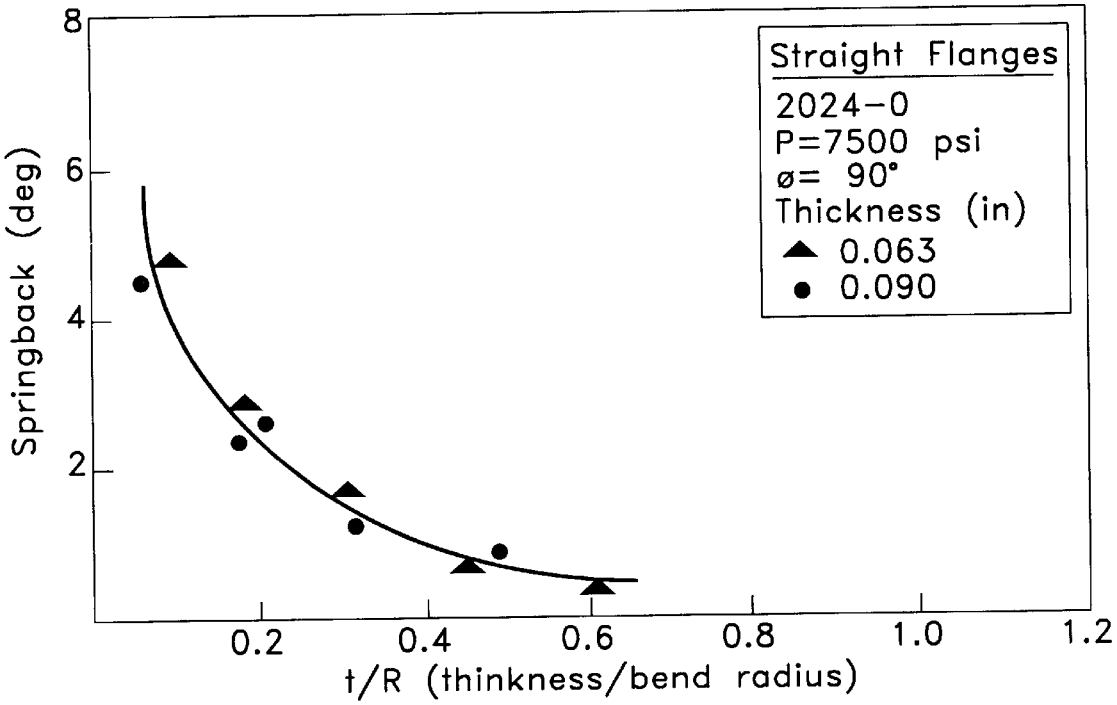
FIG. 43 illustrates a graph of a springback of the straight bend versus the thickness/bend radius (t/B.R.) for 2024-O aluminums.

The constant $k_1$ is primarily utilized for the formation of the straight bend, whereas the constant $k_2$ is used for the formation of the curved bend. Similar tests may be performed to calculate the values of $k_1$ and $k_2$. The constants $k_1$ and $k_2$ are determined by a curve fitting function for the data such that the test data from FIG. 43 (?) falls within(1 standard deviation of the plotted curve?). Thus, for the material described in FIGS. 43–46, equations (XII) and (XIII) can be rewritten as:

$$s_s=k_1[(BR)/(t)](\ominus)^{0.35}(P)^{-0.4}$$

$$s_{cb}=k_2[(BR)/(t)](\ominus)^{0.35}(CR)^{0.35}(P)^{-0.4}$$

where ($k_1$) and ($k_2$) are determined as described above. The values of $k_1$ and $k_2$ for selected materials are shown in Table 3:

TABLE 3

Values of "$k_1$" and "$k_2$"

| Material/Temper | $k_1$ | $k_2$ |
|---|---|---|
| 2024-0 | 7.4 | 1.81 |
| 2024-T4 | 13.9 | 3.4 |
| 2024-T3 | 15.9 | 3.8 |
| 2024-AQ | 12.0 | 2.9 |
| 304-Anneal | 11.7 | 2.8 |

Figure 4B:
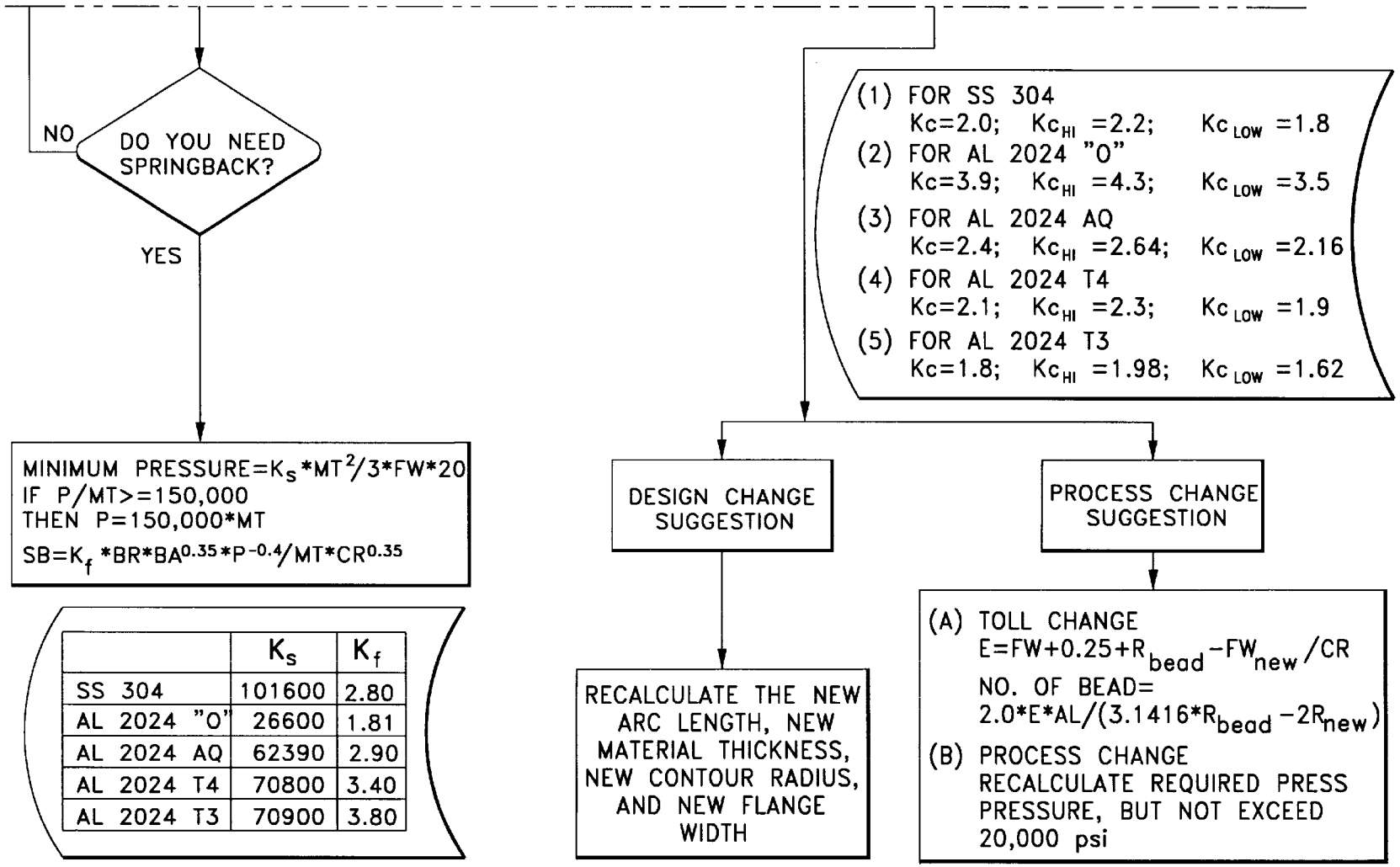
FIG. 4 show flow diagrams of the tooling operation submenu for sheet metal forming of a shrink form.

Referring now to FIG. 4B, once the constants (b/a), (n/m), (c), (d), (s), (v), ($k_1$), and ($k_2$) are determined, the spring back for a straight bend ($s_s$) can be calculated by inputting press forming pressure (P), bend angle (⊖), thickness (t), and bend radius (BR) into equation (XII), and the spring back for a curved bend ($s_{cb}$) can be calculated by inputting (P), (⊖), (t), (BR), and the curved bend contour radius (CR) into equation (XIII). The as-formed dimensions of the workpiece can then be adjusted according to the angular spring back calculated from equations (XII) and (XIII). If the resulting dimensions of the workpiece are unacceptable, the workpiece can be classified as unsuitable, and an alternative workpiece material can be selected for evaluation according to the same process. The material testing does not have to be repeated however, nor do the constants (b/a), (n/m), (c), (d), (s), (v), ($k_1$), and ($k_2$) have to be re-calculated, if the alternative workpiece is the same material. If instead, the resulting dimensions of the workpiece are acceptable, the workpiece can be classified as suitable.

Thus, while it is recognized that an illustrative and preferred embodiment has been described herein, it is likewise to be understood that the inventive concepts may be otherwise embodied and employed and that the appended claims are intended to be construed to include such variations except insofar as limited by the prior art.

What is claimed is:

1. A method for selecting a suitable workpiece having a material composition and a thickness for forming an article, the method comprising the steps of:

a) selecting a workpiece;

b) obtaining a yield strain for the workpiece material;

c) determining whether the article has at least one straight bend wherein each straight bend defines a respective straight bend axis;

d) inputting a straight bend radius and a straight bend angle for each straight bend, and calculating a straight bend strain across each respective straight bend axis in response to a determination that the article has at least one straight bend;

e) comparing the respective straight bend strains to the workpiece yield strain in response to calculating at least one straight bend strain;

f) classifying the workpiece unsuitable, selecting an alternative workpiece, and returning to step (b) in response to at least one straight bend strain being at least equal to the workpiece yield strain;

g) determining whether the article has at least one stretch flange defining a corner axis and a centerline axis;

h) inputting a bend radius, a bend arc length, a flange width, a material thickness and a contour radius for each stretch flange, and calculating a stretch flange corner strain across the corner axis and a stretch flange bottom center strain across the centerline axis for each stretch flange in response to a determination that the article has at least one stretch flange;

i) comparing the respective stretch flange corner strain and the stretch flange bottom center strain to the workpiece yield strain in response to calculating at least one stretch flange strain;

j) classifying the workpiece unsuitable, selecting an alternative workpiece and returning to step (b) in response to either the stretch flange corner strain or the stretch flange bottom center strain being at least equal to the yield strain; and k) classifying the material suitable in response to each respective calculated strain being less than the material yield strain.

2. The method of claim 1 wherein the step of calculating the straight bend strain includes measuring strain on a plurality of workpiece samples formed with straight bends, utilizing the measured strain values to develop an empirical correlation of straight bend strain as a function of bend angle, bend radius, and material thickness, and calculating a straight bend strain according to the empirical correlation.

3. The method of claim 2 wherein the straight bend strain ($e_{sb}$) is calculated according to the empirical strain correlation:

$$e_{sb}=K(t)^a(BR)^b(BA)^c,$$

where (K) is a straight bend constant for the material, (t) is the workpiece thickness, (a) is a strain thickness constant, (BR) is the straight bend radius, (b) is a straight bend radius constant, (BA) is the straight bend angle, and (c) is a straight bend angle constant.

4. The method of claim 3 wherein the constant (a) is obtained by bending the plurality of workpiece samples having unequal thicknesses to substantially equivalent respective bend angles and bend radii, measuring respective strain values of the bent samples, and developing a first logarithmic correlation of thickness relative to strain wherein the constant (a) corresponds to a slope characteristic of the first logarithmic correlation, the constant (b) is obtained by bending the plurality of workpiece material samples having substantially equivalent thicknesses to respective substantially equivalent bend angles having unequal bend radii, measuring respective strain values for the bent samples, and developing a second logarithmic correlation of bend radii relative to strain wherein the constant (b) corresponds to a slope characteristic of the second logarithmic correlation, the constant (c) is obtained by bending the plurality of workpiece material samples having substantially equivalent thicknesses to respective unequal bend angles having substantially equivalent respective bend radii, measuring respective strain values for the bent samples, and developing a third logarithmic correlation of bend angle relative to strain wherein the constant (c) corresponds to a slope characteristic of the third logarithmic correlation, and the constant K corresponds to the calculation according to the empirical strain correlation based on the obtained constants (a), (b) and Ⓒ and experimentally obtained $e_{sb}$, t, BR and BA.

5. The method of claim 4 wherein the value of $e_{sb}$ is experimentally obtained by maintaining the t and BR as the BA varies until the workpiece samples fracture, and incorporating the values of $e_{sb}$, t, BR and BA at the fracture to the empirical strain correlation to determine the constant K.

6. The method of claim 1 wherein the step of calculating the stretch flange strain includes measuring strain on a plurality of workpiece samples formed with a stretch flange, utilizing the measured strain values to develop empirical correlations of stretch flange corner strain and stretch flange bottom center strain as a function of arc length, flange width, contour radius, bend radius, and material thickness, and calculating stretch flange corner strain and stretch flange bottom center strain according to the empirical correlations.

7. The method of claim 6 wherein the bottom center stretch flange strain and stretch flange bottom centerline strain are calculated according to the empirical correlation:

$$e=K(u)^a(FW)^b(CR)^c(BR)^d(t)^e,$$

wherein (K) is a stretch flange constant for the workpiece material, (u) is the concave bend arc length, (FW) is the article flange width, (CR) is the article contour radius, (BR) is the concave bend radius, (t) is the workpiece material thickness, (a) is an arc length constant for the workpiece material, (b) is a flange width constant for the workpiece material, (c) is a contour radius constant for the workpiece material, (d) is a bend radius constant for the workpiece material, and (e) is a thickness constant for the workpiece material.

8. The method of claim 7 wherein the constant (a) is obtained by arcuately bending the plurality of workpiece samples having substantially equal thicknesses into respective concave arcuate shapes having unequal arc lengths and substantially equivalent flange widths, contour radii, and bend radii, measuring respective strain values of the bent samples, and developing a first logarithmic correlation of arc length to strain wherein the constant (a) corresponds to a slope characteristic of the first correlation.

9. The method of claim 7 wherein the constant (b) is obtained by arcuate bending the plurality of workpiece material samples having substantially equal thicknesses into respective concave arcuate shapes having unequal flange widths and substantially equivalent arc lengths, contour radii, and bend radii, measuring respective strain values of the bent samples, and developing a second logarithmic correlation of flange width to strain wherein the constant (b) corresponds to a slope characteristic of the second correlation.

10. The method of claim 7 wherein the constant (c) is obtained by arcuately bending the plurality of workpiece material samples having substantially equal thicknesses into respective concave arcuate shapes having unequal contour radii and substantially equivalent flange widths, arc lengths, and bend radii, measuring respective strain values of the bent samples, and developing a third logarithmic correlation of contour radius to strain wherein the constant Ⓒ corresponds to a slope characteristic of the third correlation.

11. The method of claim 7 wherein the constant (d) is obtained by arcuately bending the plurality of workpiece material samples having substantially equal thicknesses into respective concave arcuate shapes having unequal bend radii and substantially equivalent arc lengths, contour radii, and flange width, measuring respective strain values of the bent samples, and developing a fourth logarithmic correlation of bend radius to strain wherein the constant (d) corresponds to a slope characteristic of the fourth correlation.

12. The method of claim 7 wherein the constant (e) is obtained by arcuately bending the plurality of workpiece material samples having unequal thicknesses into respective concave arcuate shapes having substantially equivalent flange widths, contour radii, arc lengths, and bend radii, measuring respective strain values of the bent samples, and developing a fifth logarithmic correlation of material thickness to strain wherein the constant (e) corresponds to a slope characteristic of the fifth correlation.

13. The method of claim 7 wherein the stretch flange constant (K) corresponds to the calculation according to the empirical correlation based on the obtained constants (a), (b), (c), (d) and (e) and experimentally obtained e, t, u, FW, CR and BR.

14. The method of claim 13 wherein the value of e is experimentally obtained by maintaining the t, u, FW, CR, BR as the workpiece material samples bend to an onset of failure, and incorporating the values of e, t, u, FW, CR and BR at the onset of failure to the empirical correlation to determine the constant K.

15. The method of claim 1 wherein the workpiece yield strain is obtained by semi-spherically stretching a workpiece sample formed of the same material as the workpiece until the material fractures and measuring the yield strain.

16. The method of claim 1 comprises the additional steps of:

l) determining whether the article has at least one shrink flange defining a corner axis and a centerline axis;

m) inputting an arc length, a bend radius, a bend contour radius, a flange width, and a press forming pressure for each shrink flange in response to a determination that the article has at least one shrink flange;

n) calculating a straight bend strain ($e_{sb}$) across the corner axis and a bottom center strain ($e_{bc}$) across the centerline axis;

o) comparing the straight bend strain to the material yield strain and comparing the bottom center strain to a minimum buckle strain ($e_b$) for the material;

p) classifying the workpiece unsuitable, selecting an alternative workpiece, and returning to step (b) in response to a determination that the straight bend strain at least equals the material yield strain or the bottom center strain at least equals the material buckle strain; and q) classifying the workpiece suitable in response to a determination that the buckle strain exceeds the bottom center strain and the material yield strain exceeds the straight bend strain.

17. The method of claim 16 wherein the step of calculating the bottom center strain includes measuring bottom center strain on a plurality of workpiece samples formed with a shrink flange, developing a bottom center strain correlation as a function of arc length, flange width, contour radius, material thickness, and pressure, and calculating a bottom center strain with the empirical correlations.

18. The method of claim 17 wherein the bottom center strain is calculated according to the empirical correlation:

$$e=K(u)^a(FW)^b(CR)^c(t)^d(P)^f,$$

where (K) is a flange bending constant, (u) is the arc length, (a) is an arc length strain constant, (FW) is the flange width, (b) is an flange width strain constant, (CR) is the convex bend contour radius, Ⓒ is a convex bend contour strain constant, (t) is the workpiece thickness, (d) is a thickness strain constant, (P) is the press forming pressure, and (f) is a press forming pressure strain constant.

19. The method of claim 18 wherein the constant (a) is obtained by bending the plurality of workpiece samples having unequal arc lengths and substantially equivalent respective flange widths, contour radii, thicknesses, and pressures, measuring respective strain values of the bent samples, and developing a first logarithmic correlation of arc length to strain wherein the constant (a) corresponds to a slope characteristic of the first correlation.

20. The method of claim 18 wherein the constant (b) is obtained by bending the plurality of workpiece material samples having unequal flange widths and substantially equivalent respective arc lengths, contour radii, thicknesses, and pressures, measuring respective strain values of the bent samples, and developing a second logarithmic correlation of flange width to strain wherein the constant (b) corresponds to a slope characteristic of the second logarithmic correlation.

21. The method of claim 18 wherein the constant Ⓒ is obtained by bending the plurality of workpiece material samples having unequal contour radii and substantially equivalent respective arc lengths, flange widths, thicknesses, and pressures, measuring respective strain values of the bent samples, and developing a third logarithmic correlation of contour radius to strain wherein the constant Ⓒ corresponds to a slope characteristic of the third logarithmic correlation.

22. The method of claim 18 wherein the constant (d) is obtained by bending the plurality of workpiece material samples having unequal thicknesses and substantially equivalent respective arc lengths, flange widths, contour radii, and pressures, measuring respective strain values of the bent samples, and developing a fourth logarithmic correlation of thickness to strain wherein the constant (d) corresponds to a slope characteristic of the fourth logarithmic correlation.

23. The method of claim 18 wherein the constant (f) is obtained by bending the plurality of workpiece material samples having unequal pressures and substantially equivalent respective arc lengths, flange widths, contour radii, and thicknesses, measuring respective strain values of the bent samples, and developing a fifth logarithmic correlation of thickness to strain wherein the constant (f) corresponds to a slope characteristic of the fifth logarithmic correlation.

24. The method of claim 18 wherein the flange bending constant (K) corresponds to the calculation according to the empirical correlation based on the obtained constants (a), (b), (c), (d) and (t) and experimentally obtained e, u, FW, CR, t and P.

25. The method of claim 24 wherein the value of e is experimentally obtained by maintaining the u, FW, CR, t, P as the workpiece material samples bend to an onset of failure, and incorporating the values of e, u, FW, CR, t and P at the onset of failure to the empirical correlation to determine the constant K.

26. The method of claim 1 additionally comprising steps of calculating a straight bend spring back deformation of the workpiece in response to the article having at least one straight bend.

27. The method of claim 26 wherein the step of calculating the straight bend spring back deformation includes inputting a press forming pressure, measuring spring back deformation from a plurality of workpiece samples formed with a straight bend, developing a straight bend spring back correlation as a function of workpiece thickness (t), bend angle (⊖), bend radius (BR), and press forming pressure (P), and calculating the straight bend spring back deformation according to the straight bend spring back correlation.

28. The method of claim 27 wherein the straight bend spring back deformation ($s_s$) is calculated according to the correlation:

$$SBD=k_1(t)^a(\ominus)^b(BR)^c(P)^v;$$

wherein ($k_1$) is a straight bend spring back constant for the material, (a) is a thickness constant for the workpiece material, (b) is a bend angle constant for the material, Ⓒ is a bend radius constant for the material, and (v) is a press forming pressure constant for the workpiece material.

29. The method of claim 1 additionally comprising steps of calculating a curved bend spring back deformation of the workpiece in response to the article having at least one straight bend.

30. The method of claim 29 wherein the step of calculating the curved bend spring back deformation includes inputting a press forming pressure, measuring spring back deformation from a plurality of workpiece samples formed with a curved bend, developing a curved bend spring back correlation as a function of workpiece thickness (t), bend angle (Θ), bend radius (BR), contour radius (CR), and press forming pressure (P), and calculating the curved bend spring back deformation according to the straight bend spring back correlation.

31. The method of claim 30 wherein the curved bend spring back deformation ($S_{cb}$) is calculated according to the correlation:

$$SBD=k_2(t)^m(\Theta)^n(BR)^r(CR)^s(P)^v;$$

wherein ($k_2$) is a curved bend spring back constant for the material, (m) is a thickness constant for the workpiece material, (n) is a bend angle constant for the material, (r) is a bend radius constant for the material, (s) is a contour radius constant for the workpiece material, and (v) is a press forming pressure constant for the workpiece material.

32. A method of predicting failure in a workpiece having a yield strain and a thickness upon forming at least one straight bend thereto, the method comprising the steps of:

a) selecting a workpiece from a predetermined set of workpieces, each respective one of the workpieces in the predetermined set having a yield strain corresponding thereto;

b) determining whether the selected workpiece has at least one straight bend wherein each straight bend defines a respective straight bend axis;

c) inputting a straight bend radius and a straight bend angle for each straight bend;

d) calculating a straight bend strain across each respective straight bend axis in response to each of the inputted straight bend radius and straight bend angle; and e) comparing the respective straight bend strain to the workpiece yield strain for prediction of the failure in the workpiece upon forming the at least one straight bend.

33. The method of claim 32 wherein the workpiece in step a) is selected from the predetermined set of workpieces consisting of 304 stainless steel, 2024 aluminum-O, 2024 aluminum AQ, 2024 aluminum T4, and 2024 aluminum T3.

34. The method of claim 33 wherein the yield strain is 1.5 for 304 stainless steel, 1.5 for 2024 aluminum-O, 1.65 for 2024 aluminum AQ, 3.0 for 2024 aluminum T4, and 3.0 for 2024 aluminum T3.

35. The method of claim 32 wherein the step of calculating the straight bend strain includes measuring strain on a plurality of workpiece samples formed with straight bends, utilizing the measured strain values to develop an empirical correlation of the straight bend strain as a function of the bend angle, the bend radius, and the material thickness, and calculating the straight bend strain according to the empirical strain correlation.

36. The method of 35 wherein the straight bend strain ($e_{sb}$) is calculated according to the empirical strain correlation:

$$e_{sb}=K(t)^a(BR)^b(BA)^c,$$

where (K) is a straight bend constant, (t) is the workpiece thickness, (a) is a strain thickness constant, (BR) is the straight bend radius, (b) is a straight bend radius constant, (BA) is the straight bend angle, and Ⓒ is a straight bend angle constant.

37. The method of claim 36 wherein the constant (a) is obtained by bending the plurality of workpiece samples having unequal thicknesses to substantially equivalent respective bend angles and bend radii, measuring respective strain values of the bent samples, and developing a first logarithmic correlation of thickness relative to strain wherein the constant (a) corresponds to a slope characteristic of the first logarithmic correlation, the constant (b) is obtained by bending the plurality of workpiece samples having substantially equivalent thicknesses to respective substantially equivalent bend angles having unequal bend radii, measuring respective strain values for the bent samples, and developing a second logarithmic correlation of bend radii relative to strain wherein the constant (b) corresponds to a slope characteristic of the second logarithmic correlation, the constant Ⓒ is obtained by bending the plurality of workpiece samples having substantially equivalent thicknesses to respective unequal bend angles having substantially equivalent respective bend radii, measuring respective strain values for the bent samples, and developing a third logarithmic correlation of bend angle relative to strain wherein the constant Ⓒ corresponds to a slope characteristic of the third logarithmic correlation, and the constant K corresponds to the calculation according to the empirical strain correlation based on the obtained constants (a), (b) and Ⓒ and experimentally obtained $e_{sb}$, t, BR and BA.

38. The method of claim 37 wherein the value of $e_{sb}$ is experimentally obtained by maintaining the t and BR as the BA varies until the workpiece samples fracture, and incorporating the values of $e_{sb}$, t, BR and BA at the fracture to the empirical strain correlation to determine the constant K.

39. The method of claim 32 wherein the respective straight bend strain in step e) is lower than the workpiece yield strain to predict no failure in the workpiece upon forming the at least one straight bend thereto.

40. The method of claim 32 wherein the respective straight bend strain in step e) is equal to the workpiece yield strain to predict failure in the workpiece upon forming the at least one straight bend thereto.

41. The method of claim 32 wherein the respective straight bend strain in step e) is greater than the workpiece yield strain to predict failure in the workpiece upon forming the at least one straight bend thereto.

42. A method of predicting failure in a workpiece upon forming at least one stretch flange thereto, the method comprising the steps of:

a) selecting a workpiece having a yield strain;

b) determining whether the selected workpiece has at least one stretch flange defining a corner axis and a centerline axis;

c) inputting a bend radius, a bend arc length, a flange width, a material thickness and a contour radius for each stretch flange;

d) calculating a stretch flange corner strain across the corner axis and a stretch flange bottom center strain across the centerline axis for each stretch flange in response to each of the inputted bend radius, bend arc length, flange width, material thickness and contour radius; and e) comparing the respective stretch flange corner strain and the stretch flange bottom center strain to the workpiece yield strain for prediction of the failure in the workpiece upon forming the at least one stretch flange.

43. The method of claim 42 wherein the step of calculating the stretch flange strain includes measuring strain on a plurality of workpiece samples formed with stretch flanges, utilizing the measured strain values to develop an empirical correlation of the stretch flange corner strain and the stretch flange bottom center strain as a function of the arc length, the flange width, the contour radius, the bend radius, and the material thickness, and calculating the stretch flange corner strain and the stretch flange bottom center strain according to the empirical correlation.

44. The method of claim 43 wherein the bottom center stretch flange strain and the stretch flange bottom centerline strain are calculated according to the empirical correlation:

$$e=K(u)^a(FW)^b(CR)^c(BR)^d(t)^e,$$

wherein (K) is a stretch flange constant, (u) is the concave bend arc length, (FW) is the article flange width, (CR) is the article contour radius, (BR) is the concave bend radius, (t) is the workpiece material thickness, (a) is an arc length constant for the workpiece material, (b) is a flange width constant for the workpiece material, Ⓒ is a contour radius constant for the workpiece material, (d) is a bend radius constant for the workpiece material, and (e) is a thickness constant for the workpiece material.

45. The method of claim 44 wherein the constant (a) is obtained by arcuately bending the plurality of workpiece samples having substantially equal thicknesses into respective concave arcuate shapes having unequal arc lengths and substantially equivalent flange widths, contour radii, and bend radii, measuring respective strain values of the bent samples, and developing a first logarithmic correlation of arc length to strain wherein the constant (a) corresponds to a slope characteristic of the first correlation, the constant (b) is obtained by arcuately bending the plurality of workpiece samples having substantially equal thicknesses into respective concave arcuate shapes having unequal flange widths and substantially equivalent arc lengths, contour radii, and bend radii, measuring respective strain values of the bent samples, and developing a second logarithmic correlation of flange width to strain wherein the constant (b) corresponds to a slope characteristic of the second correlation, the constant Ⓒ is obtained by arcuately bending the plurality of workpiece samples having substantially equal thicknesses into respective concave arcuate shapes having unequal contour radii and substantially equivalent flange widths, arc lengths, and bend radii, measuring respective strain values of the bent samples, and developing a third logarithmic correlation of contour radius to strain wherein the constant Ⓒ corresponds to a slope characteristic of the third correlation, the constant (d) is obtained by arcuately bending the plurality of workpiece samples having substantially equal thicknesses into respective concave arcuate shapes having unequal bend radii and substantially equivalent arc lengths, contour radii, and flange width, measuring respective strain values of the bent samples, and developing a fourth logarithmic correlation of bend radius to strain wherein the constant (d) corresponds to a slope characteristic of the fourth correlation, and the constant (e) is obtained by arcuately bending the plurality of workpiece samples having unequal thicknesses into respective concave arcuate shapes having substantially equivalent flange widths, contour radii, arc lengths, and bend radii, measuring respective strain values of the bent samples, and developing a fifth logarithmic correlation of material thickness to strain wherein the constant (e) corresponds to a slope characteristic of the fifth correlation.

46. The method of claim 44 wherein the stretch flange constant (K) corresponds to the calculation according to the empirical correlation based on the obtained constants (a), (b), (c), (d) and (e) and experimentally obtained e, t, u, FW, CR and BR.

47. The method of claim 46 wherein the value of e is experimentally obtained by maintaining the t, u, FW, CR, BR as the workpiece material samples bend to an onset of failure, and incorporating the values of e, t, u, FW, CR and BR at the onset of failure to the empirical correlation to determine the constant K.

48. The method of claim 42 wherein the respective stretch flange corner strain in step e) is lower than the workpiece yield strain to predict no failure in the workpiece upon forming the at least one stretch flange thereto.

49. The method of claim 42 wherein the respective stretch flange bottom center strain in step e) is lower than the workpiece yield strain to predict no failure in the workpiece upon forming the at least one stretch flange thereto.

50. The method of claim 42 wherein the respective stretch flange corner strain in step e) is greater than the workpiece yield strain to predict failure in the workpiece upon forming the at least one stretch flange thereto.

51. The method of claim 42 wherein the respective stretch flange bottom center strain in step e) is greater than the workpiece yield strain to predict failure in the workpiece upon forming the at least one stretch flange thereto.

52. A method of predicting failure in a workpiece having a yield strain and a thickness upon forming at least one shrink flange thereto, the method comprising the steps of:

a) selecting a workpiece from a predetermined set of workpieces, each respective one of the workpieces in the predetermined set having a yield strain corresponding thereto;

b) determining whether the selected workpiece has at least one shrink flange defining a corner axis and a centerline axis;

c) inputting an arc length, a bend radius, a bend contour radius, a flange width, and a press forming pressure for each shrink flange;

d) calculating a straight bend corner strain across the corner axis and a straight bend bottom center strain across the centerline axis for each shrink flange in response to each of the inputted arc length, bend radius, bend contour radius, flange width and press forming pressure;

e) comparing the respective straight bend corner strain and the straight bend bottom center strain to the workpiece yield strain for prediction of the failure in the workpiece upon forming the at least one shrink flange.

53. The method of claim 52 wherein the workpiece in step a) is selected from the predetermined set of workpieces consisting of 304 stainless steel, 2024 aluminum-O, 2024 aluminum AQ, 2024 aluminum T4, and 2024 aluminum T3.

54. The method of claim 53 wherein the yield strain is 1.5 for 304 stainless steel, 1.5 for 2024 aluminum-O, 1.65 for 2024 aluminum AQ, 3.0 for 2024 aluminum T4, and 3.0 for 2024 aluminum T3.

55. The method of claim 52 wherein the step of calculating the bottom center strain includes measuring bottom center strain on a plurality of workpiece samples formed with a shrink flange, developing a bottom center strain correlation as a function of arc length, flange width, contour radius, material thickness, and pressure, and calculating a bottom center strain with the empirical correlations.

56. The method of claim 55 wherein the bottom center strain is calculated according to the empirical correlation:

$$e=K(u)^a(FW)^b(CR)^c(t)^d(P)^f,$$

where (K) is a flange bending constant, (u) is the arc length, (a) is an arc length strain constant, (FW) is the flange width, (b) is an flange width strain constant, (CR) is the convex bend contour radius, Ⓒ is a convex bend contour strain constant, (t) is the workpiece thickness, (d) is a thickness strain constant, (P) is the press forming pressure, and (f) is a press forming pressure strain constant.

57. The method of claim 56 wherein the constant (a) is obtained by bending the plurality of workpiece samples having unequal arc lengths and substantially equivalent respective flange widths, contour radii, thicknesses, and pressures, measuring respective strain values of the bent samples, and developing a first logarithmic correlation of arc length to strain wherein the constant (a) corresponds to a slope characteristic of the first correlation, the constant (b) is obtained by bending the plurality of workpiece samples having unequal flange widths and substantially equivalent respective arc lengths, contour radii, thicknesses, and pressures, measuring respective strain values of the bent samples, and developing a second logarithmic correlation of flange width to strain wherein the constant (b) corresponds to a slope characteristic of the second logarithmic correlation, the constant Ⓒ is obtained by bending the plurality of workpiece samples having unequal contour radii and substantially equivalent respective arc lengths, flange widths, thicknesses, and pressures, measuring respective strain values of the bent samples, and developing a third logarithmic correlation of contour radius to strain wherein the constant Ⓒ corresponds to a slope characteristic of the third logarithmic correlation, the constant (d) is obtained by bending the plurality of workpiece samples having unequal thicknesses and substantially equivalent respective arc lengths, flange widths, contour radii, and pressures, measuring respective strain values of the bent samples, and developing a fourth logarithmic correlation of thickness to strain wherein the constant (d) corresponds to a slope characteristic of the fourth logarithmic correlation, and the constant (f) is obtained by bending the plurality of workpiece samples having unequal pressures and substantially equivalent respective arc lengths, flange widths, contour radii, and thicknesses, measuring respective strain values of the bent samples, and developing a fifth logarithmic correlation of thickness to strain wherein the constant (f) corresponds to a slope characteristic of the fifth logarithmic correlation.

58. The method of claim 56 wherein the flange bending constant (K) corresponds to the calculation according to the empirical correlation based on the obtained constants (a), (b), (c), (d) and (f) and experimentally obtained e, u, FW, CR, t and P.

59. The method of claim 58 wherein the value of e is experimentally obtained by maintaining the u, FW, CR, t, P as the workpiece samples bend to an onset of failure, and incorporating the values of e, u, FW, CR, t and P at the onset of failure to the empirical correlation to determine the constant K.

60. The method of claim 52 wherein the respective straight bend corner strain in step e) is lower than the workpiece yield strain to predict no failure in the workpiece upon forming the at least one stretch flange thereto.

61. The method of claim 52 wherein the respective straight bend corner strain in step e) is greater than the workpiece yield strain to predict failure in the workpiece upon forming the at least one stretch flange thereto.

62. The method of claim 52 wherein the respective straight bend bottom center strain in step e) is lower than the workpiece yield strain to predict no failure in the workpiece upon forming the at least one stretch flange thereto.

63. The method of claim 52 wherein the respective straight bend bottom center strain in step e) is greater than the workpiece yield strain to predict failure in the workpiece upon forming the at least one stretch flange thereto.

* * * * *